US011041345B2

(12) United States Patent
Wijning et al.

(10) Patent No.: US 11,041,345 B2
(45) Date of Patent: Jun. 22, 2021

(54) HANDLING, TESTING, STORING AN IN-RISER LANDING STRING ASSEMBLY ONBOARD A FLOATING VESSEL

(71) Applicant: ITREC B.V., Schiedam (NL)

(72) Inventors: Diederick Bernardus Wijning, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/608,507

(22) PCT Filed: Apr. 24, 2018

(86) PCT No.: PCT/NL2018/050264
§ 371 (c)(1),
(2) Date: Oct. 25, 2019

(87) PCT Pub. No.: WO2018/199751
PCT Pub. Date: Nov. 1, 2018

(65) Prior Publication Data

US 2020/0181992 A1 Jun. 11, 2020

(30) Foreign Application Priority Data

Apr. 26, 2017 (NL) ..... 2018792

(51) Int. Cl.
*E21B 19/14* (2006.01)
*E21B 19/15* (2006.01)
(Continued)

(52) U.S. Cl.
CPC ..... *E21B 19/143* (2013.01); *E21B 19/155* (2013.01); *E21B 19/16* (2013.01); *B63B 35/4413* (2013.01); *E21B 15/02* (2013.01)

(58) Field of Classification Search
CPC ..... E21B 15/02; E21B 19/143; E21B 19/155; E21B 19/16; B63B 35/4413
See application file for complete search history.

(56) References Cited

U.S. PATENT DOCUMENTS 2,999,549 A * 9/1961 Stratton ..... E21B 15/02 175/5
4,850,439 A * 7/1989 Lund ..... E21B 19/20 175/52
(Continued)

FOREIGN PATENT DOCUMENTS

EP 0199664 A2 10/1986
WO WO 87/02915 A1 5/1987
(Continued)

OTHER PUBLICATIONS

International Search Report, issued in PCT/NL2018/050264, PCT/ISA/210, dated Aug. 20, 2018.
(Continued)

*Primary Examiner* — James G Sayre
(74) *Attorney, Agent, or Firm* — Birch, Stewart, Kolasch & Birch LLP

(57) ABSTRACT

A method for handling and/or testing an in-riser landing string assembly onboard a floating vessel, which method comprises the use of an in-riser landing string assembly cart, e.g. a skiddable in-riser landing string assembly cart, having a cart base, e.g. a cart base configured to be skidded over skid rails on a deck of the vessel, and having a support tower erected on said cart base. The in-riser landing string assembly is arranged and retained in vertical orientation on said cart with the support tower providing lateral support for the in-riser landing string assembly, e.g. the in-riser landing string assembly being temporarily secured to the tower at different elevations along the height of the support tower.

12 Claims, 21 Drawing Sheets

(51) Int. Cl.

| | |
|---|---|
| ***E21B 19/16*** | (2006.01) |
| ***B63B 35/44*** | (2006.01) |
| ***E21B 15/02*** | (2006.01) |

(56) References Cited

U.S. PATENT DOCUMENTS

| | | | | |
|---|---|---|---|---|
| 4,854,400 | A | 8/1989 | Simpson | |
| 6,217,258 | B1 * | 4/2001 | Yamamoto | E21B 15/02 175/5 |
| 6,581,698 | B1 | 6/2003 | Dirks | |

FOREIGN PATENT DOCUMENTS

| | | | |
|---|---|---|---|
| WO | WO 2006/068497 | A1 | 6/2006 |
| WO | WO 2014/168471 | A1 | 10/2014 |
| WO | WO 2016/105187 | A1 | 6/2016 |

OTHER PUBLICATIONS

Search Report issued in NL priority application 2018792, dated Jul. 31, 2017.

Written Opinion of the International Searching Authority, issued in PCT/NL2018/050264, PCT/ISA/237, dated Aug. 20, 2018.

* cited by examiner

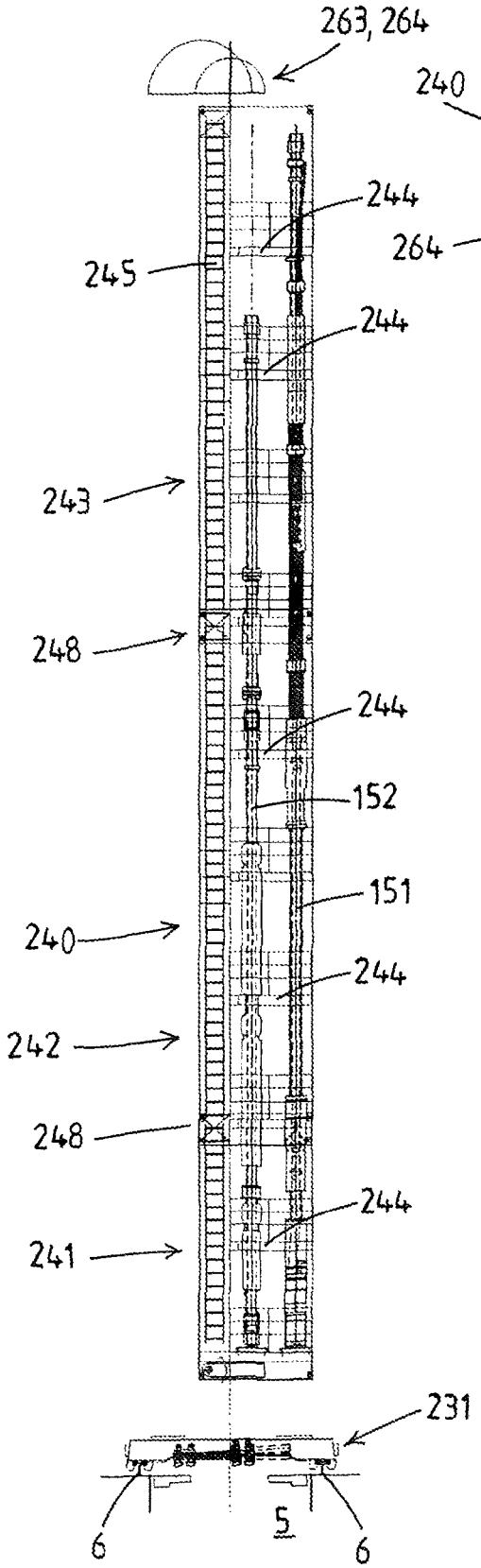
Fig.10a
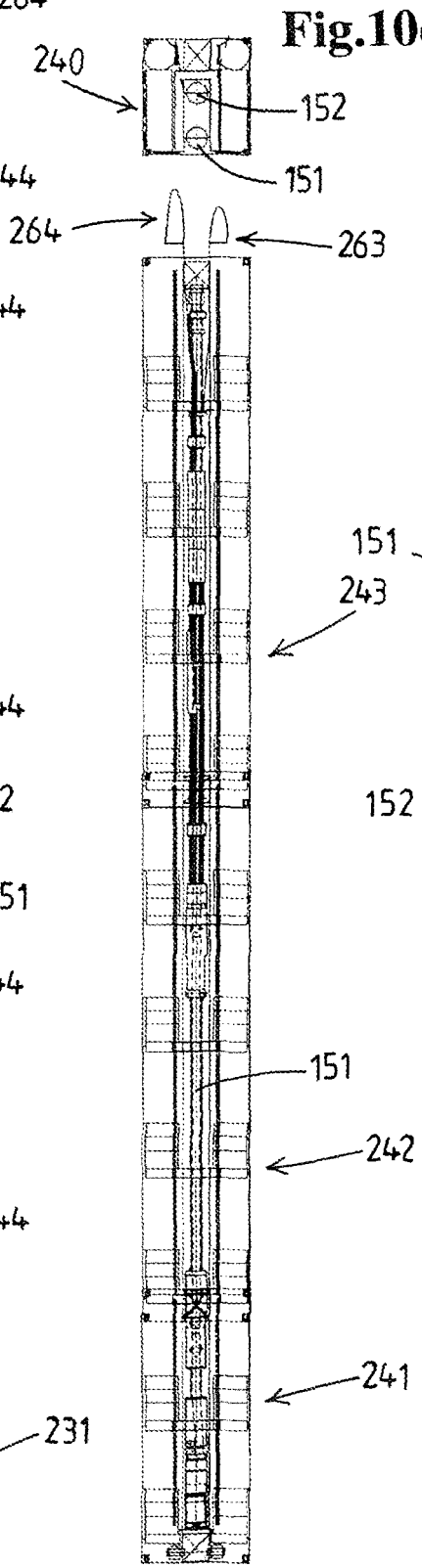
Fig.10b
Fig.10c
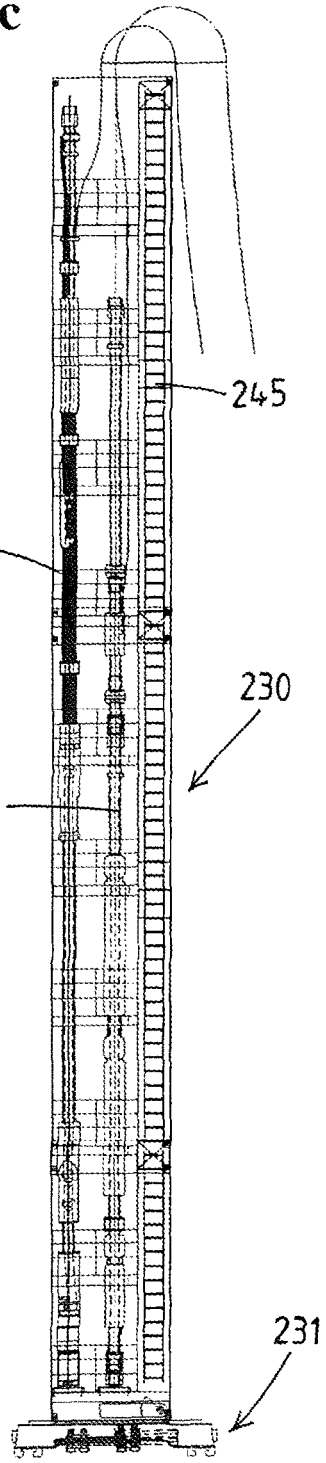
Fig.10d

HANDLING, TESTING, STORING AN IN-RISER LANDING STRING ASSEMBLY ONBOARD A FLOATING VESSEL

FIELD OF THE INVENTION

The present invention relates to the handling, testing, and storing of an in-riser landing string assembly onboard a floating vessel.

BACKGROUND OF THE INVENTION

Generally an in-riser landing string assembly is configured to be deployed from a floating vessel, e.g. from a dynamically positioned vessel, inside a marine riser that extends between the vessel and subsea well equipment, e.g. a BOP stack and/or subsea tree, by means of landing string tubing in order to conduct one or more well related operations. These operations may for example comprise flow testing, drill stem testing, well testing, reservoir clean-up, well completion, well stimulation, well intervention, well abandonment, well fracturing, etc.

In practice the deployment involves lowering the landing string inside the marine riser until the in-riser landing string assembly, at least the relevant part thereof, is accommodated in the subsea well equipment, e.g. landed onto the tubing hanger of the subsea equipment, e.g. the production tubing hanger.

Generally an in-riser landing string assembly comprises a series of interconnected components, of which a few non-limiting examples will be discussed briefly below.

A rather common component in an in-riser landing string assembly is the Sub Sea Test Tree (SSTT) component which is provided with one or more isolation valves, e.g. two isolation valves in series. For example an SSTT component comprises one or two ball valves, e.g. one ball valve and a flapper valve, in order to provide a dual safety barrier to contain well pressure. The one or more ball valves can be designed to have cutting functionality to cut coiled tubing, slickline, and/or wireline. For example one ball valve performs such a cutting action, whereas the other valve is redundant to perform seal functionality. It is also known to provide a dedicated coiled tubing cutter (CTCM) component, solely dedicated to cut coiled tubing, e.g. as a replacement for the cutting functionality of one or more of the valves in the SSTT component or in addition to this functionality of an SSTT component.

A further rather common component in an in-riser landing string assembly is a retainer valve component which is configured to retain fluids, e.g. hydrocarbons, in the landing string in the event of a disconnect, e.g. in case of an emergency where the landing string and possibly also the marine riser need to be disconnected from the subsea well equipment. Commonly the retainer valve component is arranged in the in-riser landing string assembly so as to be located above BOP shear rams, e.g. immediately above a shear sub component of the landing string assembly.

In order to allow for controlled, commonly very rapid, disconnection from the subsea well equipment, a further common component of the in-riser landing string assembly is a latch mechanism component, e.g. hydraulic latch mechanism component. This component commonly allows for controlled latching and unlatching of the landing string, e.g. in a rapid disconnect of the landing string in case of an emergency. The control can for instance be done via one or more hydraulic lines, e.g. integrated in an umbilical that is passed down through the marine riser. The latch mechanism is commonly arranged above the SSTT component and below a shear sub component.

A shear sub component is provided commonly above the SSTT component and below the retainer valve component and is adapted to be located at the height of shear rams of a BOP stack and to be sheared by said rams.

Another rather common component of an in-riser landing string assembly is the tubing hanger running tool (THRT) component, which is commonly located at the lower end of the assembly and is adapted to be landed onto a (production) tubing hanger of the subsea equipment.

Sometimes an additional orientation component, e.g. a tubing hanger orientation joint component is included in the assembly.

In embodiments the in-riser landing string assembly comprises a hydraulic pressure accumulator component, e.g. in view of deepwater use for effective and rapid control of one or more hydraulic functions of one or more components of the assembly.

In embodiments the in-riser landing string assembly comprises a bleed off valve component, e.g. to be mounted above the retainer valve module or even integrated with the retainer valve component. This bleed off valve may serve to bleed the small amount of fluid trapped between the SSTT component and the retainer valve component, e.g. into the marine riser.

Yet another component that may be included in an in-riser landing string assembly is a slick joint component, which may for example be mounted below the SSTT component, e.g. to provide an external surface that is configured to be sealingly engaged by any pipe rams of a BOP stack in order to provide an annulus isolation. A slick joint component can also be arranged at other locations in the assembly to have components arranged at the correct height in the assembly in view of the subsea equipment into which it is to be accommodated. For example a slick joint component can be located between the shear sub component and retainer valve.

Another known component of an in-riser landing string assembly is an adjustable fluted hanger component, e.g. at lower end of the assembly.

It will be appreciated by the skilled person that many operations require the in-riser landing string assembly to contain at least the SSTT component, the retainer valve component, and often also a tubing hanger running tool (THRT) component. As explained the assembly may also be assembled to contain a different set of components, including one or more components that have not been mentioned above, like a pump component, a chemical injection component, etc.

In order to provide power and/or control signals to the in-riser landing string assembly, or to feed chemicals in view of downhole chemical injection, etc., it is known to use one or more umbilicals or the like that is/are passed down through the marine riser to the assembly. Also it is known to provide interconnecting lines, electrical and/or hydraulic, between components of the assembly. For example it is known to pass such interconnecting lines along the outside of the shear sub so that these lines are also sheared upon operation of the shear rams of the BOP. For example a TRHT component may be connected to one or more electric and/or hydraulic lines for control thereof. Downhole chemical injection may for instance be done in view of introducing nitrogen, or in view of corrosion prevention or hydrate formation.

In view of control or components of the in-riser landing string assembly and/or the monitoring of parameters, e.g. like pressure and/or temperature, the assembly may be embodied to establish two-way communication with the vessel, e.g. via an umbilical passing through the marine riser. For example it is known to have an electro-hydraulic multiplex control system. It is noted that it is known to have an open water hydraulic umbilical outside of the marine riser in combination with wireline logging cable routed down inside riser to landing string assembly.

In view of control and/or communication the in-riser landing string assembly may include a subsea electronics or instrumentation module component, e.g. configured to handle multiplexed signals from the vessel to control one or more components of the assembly, for example connected via a logging cable type umbilical. Such a subsea electronics module component may also be configured to feedback information to the vessel at the water surface, e.g. concerning status of components, temperature, and/or pressure, e.g. establishing a two-way communication.

A landing string instrumentation component may be embodied to communicate parameter data via electromagnetic signals, e.g. electric signals, or other signals sent through a communication line, such as an electrical line or optical fiber. A landing string instrumentation component may also be embodied to communicate parameter data via other output signals, such as hydraulic or mechanical output signals.

The assembly may comprise communication lines to communicate signals and/or data to or from other landing string components. In embodiments a landing string instrumentation component may be in communication with latch mechanism component via one or more communication lines.

In practical situations a complete in-riser landing string assembly is a colossal part, e.g. having a length (or height when seen upright) of over 12 meters, e.g. of more than 20 meters, or even more as will be explained below, with a significant weight as all or most components are designed to be resistant to enormous pressures and loads. Additionally the complete assembly is very expensive and, more importantly, very strict requirements are placed on its functionality as the assembly commonly performs a crucial role in view of safety, e.g. by allowing for a very rapid and safe disconnect. These requirements, as well as the complexity of the various components in the assembly, bring along rigorous testing of the components and the entirety of the landing string assembly before it is deployed into the marine riser.

OBJECTS OF THE INVENTION

The present invention aims to provide measures that allow for enhanced handling and/or storage of an in-riser landing string assembly, e.g. prior to its deployment, onboard the vessel.

The present invention also aims to provide measures that allow for enhanced testing of and/or maintenance work on a complete in-riser landing string assembly, e.g. prior to its deployment, onboard the vessel.

SUMMARY OF THE INVENTION

The present invention provides a method for handling an in-riser landing string assembly onboard a floating vessel, which in-riser landing string assembly is configured to be deployed from said vessel inside a marine riser that extends between said vessel and subsea well equipment by means of landing string tubing in order to conduct one or more operations, wherein the method comprises, onboard said vessel, transferring the in-riser landing string assembly between a remote location and a deployment location.

In the inventive method use is made of an in-riser landing string assembly cart, e.g. a skiddable in-riser landing string assembly cart, having a cart base, e.g. a cart base configured to be skidded over skid rails of the vessel, and having a support tower erected on said cart base, wherein the in-riser landing string assembly is arranged and retained in vertical orientation on said cart with the support tower providing lateral support for the in-riser landing string assembly, e.g. the in-riser landing string assembly being temporarily secured to the support tower at different elevations along the height of the support tower, and wherein the cart with said in-riser landing string assembly arranged and retained in vertical orientation thereon is moved between said remote location and said deployment location above the marine riser.

By providing the cart with support tower for the in-riser landing string assembly the handling of the assembly, or interconnectable assemblies as will be explained below, is much more efficient than in the prior art. It is noted that some subsea well related operations require the landing string assembly to the deployed and retrieved again more than once during the operation, with the assembly having to be placed remote from the deployment location in the meantime.

The invention also envisages an embodiment wherein the support tower, detached from the cart base as preferred, is stored in horizontal orientation thereof onboard the vessel with an in-riser landing string assembly being retained in horizontal orientation by said support tower. Then it is envisaged that the support tower and the in-riser landing string assembly retained thereby, is brought from this horizontal into vertical orientation, e.g. using drawworks of a drilling rig of the vessel or another crane onboard the vessel. This approach is much more efficient than the prior art approach wherein the complete assembly is transferred in horizontal orientation to the deployment location, e.g. onto the rig floor, and then one end of the assembly itself is connected to a crane, e.g. the drawworks of the drilling installation, and then lifted in order for the complete assembly to be brought into vertical orientation. This manoeuvre carried out in this prior art manner also bring along an increased risk of damage to one or more components of the assembly, and/or to one or more lines, hoses, of the assembly.

Preferably the horizontal storage and upending of the support tower together with the in-riser landing string assembly is done with the cart body not attached to the support tower, for example the cart base being a general purpose skid cart base or skid pallet present onboard the vessel. Similarly, when the in-riser landing string assembly is no longer need after having completed an operation, the support tower retaining the in-riser landing string assembly can be lifted or otherwise detached from the cart body and brought in horizontal orientation, e.g. to be so stored at a remote location onboard the vessel.

In an embodiment the vessel is provided with a catwalk machine and the support tower together with the in-riser landing string assembly retained by the support tower is placed in horizontal orientation on the catwalk machine, e.g. by means of a crane, e.g. a gantry crane of the vessel, wherein the catwalk machine is then operated to advance the support tower together with the in-riser landing string assembly retained by the support tower towards the rig floor, e.g. with the forward (and later upper end) of the support tower being connected to a drawworks of a rig of the vessel, e.g. suspended from a travelling trolley that travels over one or more vertical rails on a mast of the vessel. Once upended the tower is mounted on the cart base and secured thereto.

In an embodiment, e.g. when a planned operation involves the use of a very tall in-riser landing string assembly, it is envisaged that the support tower retains multiple interconnectable in-riser landing string assemblies simultaneously. For instance a method is envisaged wherein the support tower retains both a lower in-riser landing string assembly and an upper in-riser landing string assembly simultaneously, which are interconnected during the deployment process. For example the lower assembly comprises at least the SSTT component and the retainer valve component, e.g. also the THRT component. The upper assembly for example comprises one or more of a chemical injection component, e.g. a gas (for example nitrogen gas) injection component, an instrumentation or electronics component, etc.

For example, in an embodiment, the method involves arranging the cart with support tower retaining the in-riser landing string assembly at a testing location remote, e.g. somewhat remote from the deployment location, e.g. between 5 and 15 meters offset from the deployment location, and performing one or more tests on one or more components of the complete assembly at said testing location.

For example, in an embodiment, the method involves the use of landing string assembly umbilical winch, e.g. arranged adjacent the deployment location or a mobile winch that is to be arranged adjacent the deployment location, e.g. along a side of the rig floor, e.g. also adjacent the testing location, and connecting the umbilical thereof to the in-riser landing string assembly retained by the support tower whilst the cart is still offset from the deployment location, with the later displacement of the cart to the deployment location. This allows to perform the connection of the umbilical to the assembly in an offset location, e.g. the testing location, so that the connection to the umbilical and the components can be fully tested in said offset testing location. This allows to perform, simultaneous with said testing, other activities at the deployment location, so in the firing line into the marine riser. For example tripping of drill tubing, etc.

In an embodiment the method involves the use of multiple landing string assembly umbilical winches, e.g. in combination with the support tower retaining multiple interconnectable in-riser landing string assemblies simultaneously and each assembly being connected to at least one respective umbilical.

In view of the advantages achieved in the testing, the present invention also relates to a method for testing an in-riser landing string assembly onboard a floating vessel, which in-riser landing string assembly is configured to be deployed from said vessel inside a marine riser that extends between said vessel and subsea well equipment by means of landing string tubing in order to conduct one or more operations, and wherein an umbilical extends through the marine riser down to the in-riser landing string assembly, wherein the method comprises, onboard said vessel, testing the in-riser landing string assembly connected to the umbilical prior to deployment thereof at a deployment location where the in-riser landing string assembly is above the marine riser.

In the inventive testing method use is made of an in-riser landing string assembly cart, e.g. a skiddable in-riser landing string assembly cart, having a cart base, e.g. a cart base configured to be skidded over skid rails of the vessel, and having a support tower erected on said cart base, wherein the in-riser landing string assembly is arranged and retained in vertical orientation on said cart with the support tower providing lateral support for the in-riser landing string assembly, e.g. the in-riser landing string assembly being temporarily secured to the support tower at different elevations along the height of the support tower, and wherein the cart with said in-riser landing string assembly arranged and retained in vertical orientation thereon is arranged at a testing location that is remote from the deployment location, wherein one or more tests are performed on the in-riser landing string assembly and/or components thereof whilst at said testing location, preferably with the umbilical connected during said one or more tests, and wherein the cart with said in-riser landing string assembly arranged and retained in vertical orientation thereon, preferably with the umbilical remaining connected, is then moved from said remote testing location to said deployment location above the marine riser.

Compared to the prior art approach the testing of the assembly, components thereof, and the umbilical connection, can be done much more efficient.

It will be appreciated that also in this testing method the support tower may retain multiple, e.g. a lower and an upper, interconnectable in-riser string landing assemblies simultaneously.

In an embodiment the method comprises the deployment of the in-riser landing string assembly into the marine riser, wherein multiple landing string tubing joints, e.g. as pre-assembled multi-joint landing string tubing stands, are added to the landing string and so the assembly is lowered down in the marine riser until the subsea equipment, e.g. comprising a BOP stack, is reached where the assembly is accommodated.

In an embodiment the deployment of the landing string into the marine riser is done with the cart having been relocated or moved into an offset location, e.g. into the testing location, remote, e.g. somewhat remote, from the deployment location, with the umbilical passing from an umbilical winch over a guide that is mounted on the support tower on the cart, possibly with an auxiliary guide for the umbilical being arranged at the deployment location, e.g. above the well center of the rig floor.

In an embodiment the support tower is provided with multiple umbilical guides to support and guide multiple umbilicals, e.g. in combination with the support tower simultaneously retaining multiple interconnectable assemblies, e.g. a lower in-riser landing string assembly and an upper in-riser landing string assembly.

In an embodiment the support tower has a tower height of at least 12 meters, e.g. of between 20 and 36 meters, e.g. of about 24 meters (80 ft.) or 30 (100 ft.) meters.

In an embodiment the support tower comprises and is composed of interconnected tower parts each having a length of 6 or 12 meters, 20 ft. or 40 ft., e.g. each tower part being configured for shipment and/or handling and/or storage as a 20 ft. or 40 ft. ISO intermodal freight container.

For example each tower part is at axial ends thereof provided with ISO container corner fitting members.

For example the tower parts are releasably connected to each other and/or to the cart base via one or more releasable fastener members, e.g. locking members configured to cooperate with ISO container corner fitting members on the tower parts, bolts, pins, etc.

For example each tower part, e.g. of two or three tower parts making up the entire tower or the majority of the height of the support tower, has a rigid structural frame of an elongated shape with longitudinal main chords that each extend between corners of the structural frame at opposed axial ends thereof and with brace members interconnecting the main chords, e.g. in one or more faces of the structural frame.

In an embodiment a structural frame of the support tower or of the one or more tower parts thereof is/are embodied with a recessed receiving space for an in-riser landing string assembly, or for multiple, e.g. two, in-riser landing string assemblies, which recessed receiving space is open in a lateral side, e.g. in a front side, of said structural frame. This e.g. allows to introduce and remove one or more components of a landing string assembly, preferably an entire landing string assembly, and/or or a landing string tubing joint and/or a stand of multiple landing string tubing joints, in lateral direction from the outside into said recessed receiving space and vice versa.

In an embodiment a, preferably tested, in-riser landing string assembly is transferred by means of the cart, e.g. skidded, into the deployment location, so above the marine riser or in other terms in the firing line.

When the cart with the in-riser landing string assembly is arranged at the deployment location one or more landing string tubing joints or stands may be connected to the top end of the assembly and the assembly is then suspended from said one or more landing string tubing joints or stands so that the cart can now be moved away and placed at a remote location, e.g. back to a testing location, e.g. somewhat remote from the deployment location. The assembly can now be lowered until a slip device can engage on a landing string tubing. Then, as is common, the landing string can be lengthened stepwise in a tripping process by adding landing string tubing joints or stands, e.g. until the assembly is landed onto a tubing hanger of the subsea equipment.

In a deployment process involving the use of a support tower retaining multiple interconnectable in-riser landing string assemblies a first or lower assembly could, for example, be suspended from a drawworks and lowered so that its top end is proximity of a rig floor level and held by some device, and then a second or upper assembly is placed and secured on top of the first or lower assembly.

In an embodiment the tower is provided with multiple access platforms at different elevations along the height of the tower allowing personnel to access the in-riser landing string assembly and components thereof via said platforms. For example access platforms are arranged at vertical intervals of about 3 meters or 10 ft. along the height of the support tower. For example each platform is provided with a recess corresponding to the recessed receiving space of the structural frame of the tower or tower part. For example each platform is provided with railings.

In an embodiment the support tower comprises a ladder and/or stairs allowing personnel to reach the multiple access platforms. One can also provide access via a man-riding member, e.g. held by a motion arm assembly as described herein.

In an embodiment the support tower is provided with one or more guides for one or more umbilicals or the like, e.g. semi-circular guides, sheaves, etc. e.g. in proximity of the top of the tower.

In an embodiment the cart base is embodied as a skiddable cart base, e.g. as preferred skiddable in two orthogonal directions over a rail system of the vessel having rails in said two orthogonal directions, e.g. with a skid mechanism operable to move the cart base in an X-direction and another skid mechanism operable to move the cart base in a Y-direction. For example the vessel has a pair of skid rails extending over a rig floor, along opposite sides of a well center, with the cart base being so skiddable into the deployment location above or adjacent the well center.

In an embodiment it is envisaged that the support tower is detachable from the cart base, e.g. with releasable fastener members being provided to connect the support tower to the cart base. This may for example allow for storage of the support tower in horizontal orientation, possibly further separated into separate tower parts, e.g. tower parts embodied to be handled as 20 ft. or 40 ft. ISO intermodal freight containers.

In an embodiment the vessel has a wellbore activities installation which comprises:

- a mast,
- a rig floor having a well center at the deployment location through which a tubulars string can pass along a firing line, e.g. into the marine riser,
- a tubulars storage rack adjacent the mast for storage therein of multi-joint tubular stands,
- at least one vertical trolley rail extending along the mast,
- a trolley, said trolley being guided along said at least one vertical trolley rail,
- a top drive device attached or to be attached to the trolley, said top drive device comprising one or more top drive motors, e.g. electric top drive motors, adapted to impart rotary motion to a tubulars string when connected to said top drive device,
- a hoisting device or drawworks adapted to move the trolley with the top drive device up and down along said at least one vertical trolley rails,
- a vertical motion arm rail extending along the mast,
- a motion arm assembly comprising a motion arm base and an extensible and retractable motion arm, wherein the motion arm base is guided said at least one vertical motion arm rail, and wherein the motion arm has an operative reach that encompasses the firing line, said motion arm assembly being adapted to support at least one of a well center tool, e.g. an iron roughneck tool, or a tubular gripper member, and allowing to bring said well center tool or tubular gripper member in the firing line, e.g. allowing to operate the motion arm assembly as a piperacker for transfer of tubular stands between the storage rack and the firing line,
- a vertical motion arm drive adapted to move the motion arm base along said vertical motion arm rail.

In an embodiment the support tower of the cart is embodied so that the assembly held by the support tower can be brought, e.g. skidded, into a location that is within operative reach of the motion arm assembly. For example, as preferred, the deployment location corresponds to this situation. This, for example, allows to place a landing string tubing joint or pre-assembled landing string tubing stand above the assembly held by the support tower and to make the connection between them. It may also allow for the handling of the assembly and/or one or more components thereof by means of the motion arm assembly.

In an embodiment an inventive method envisages the handling of one or more components of the in-riser string landing assembly by means of the motion arm assembly, e.g. in order to place one or more components along the tower when assembling the assembly or when dismantling the assembly.

The present invention also relates to a method for handling an in-riser landing string assembly onboard a floating vessel, which in-riser landing string assembly is configured to be deployed from said vessel inside a marine riser that extends between said vessel and subsea well equipment by means of landing string tubing in order to conduct one or more operations, characterized in that, the method comprises the use of a support tower that is configured to retain the in-riser landing string assembly in vertical orientation and to provide lateral support for the in-riser landing string assembly, e.g. the in-riser landing string assembly being temporarily secured to the support tower at different elevations along the height of the support tower.

As explained herein the support tower may be provided with or mounted onto a cart base, e.g. a skiddable cart base, allowing to transfer the cart comprising said cart base and support tower, whilst retaining the in-riser landing string assembly, between various locations, e.g. including a deployment location, a testing location, or otherwise. However, the use of a support tower may also be advantageous in embodiments wherein the tower placed onto some stationary base, for example a stationary base arranged, e.g. temporarily, at the well center of a rig floor of the vessel.

As explained the use of a support tower may also be advantageous when the support tower and the one or more in-riser landing string assemblies retained by said support tower are stored onboard in horizontal orientation and then brought as a unit into vertical orientation, e.g. to be mounted on the cart base. Herein a crane, e.g. a drawworks of the vessel, may be coupled to an end of the still horizontal support tower and then said end may be lifted to upend the unit. This approach allows to avoid any undue load on the one or more assemblies retained by the support tower.

In combination with the support tower having a recess receiving space for the one or more, e.g. two, assemblies with a structural frame of the support tower, the tower in horizontal orientation also may serve as protective storage facility for the one or more assemblies.

In view of horizontal storage of the support tower whilst retaining one or more in-riser landing string assemblies, the tower may also comprise platforms that are horizontal when the tower is horizontal, so as to provide enhanced access for personnel to the one or more assemblies, e.g. for preparation of the assembly from various components. As explained, the tower may also be provided with platforms that are horizontal when the tower is vertical.

The present invention also relates to a vessel provided with an in-riser landing string assembly cart and/or with a support tower as described herein.

The present invention also relates to a method for performing a subsea well operation wherein use is made of a vessel provided with an in-riser landing string assembly cart and/or with a support tower as described herein.

The present invention also relates to an in-riser landing string assembly cart as described herein.

The present invention also relates to a support tower configured to support an in-riser landing string assembly as described herein.

The present invention also relates to an in-riser landing string assembly cart as described herein retaining one or more in-riser landing string assemblies.

The present invention also relates to onboard of the vessel horizontally storing one or more one or more in-riser landing string assemblies in a support tower in horizontal orientation, and upending the support tower with said one or more in-riser landing string assemblies as a unit, e.g. by means of a drawworks of the vessel. In an embodiment the upended unit is placed or otherwise mounted onto a cart base, e.g. a skiddable cart base.

The present invention also relates to a method for installation of production tubing into a subsea well, wherein an in-riser landing string assembly is connected to the production tubing, e.g. via a THRT component of said assembly being interconnected with a tubing hanger of said production tubing, wherein said interconnection is made in proximity of the level of a rig floor of a floating vessel. For example use is made of a cart as described herein.

BRIEF DESCRIPTION OF THE DRAWINGS

The invention will now be explained with reference to the drawings. In the drawings:

FIG. 11*a-c* illustrate the 40 ft. tower parts of the cart of FIG. 10*a-d,*

FIG. 12*a-c* illustrate the 20 ft. tower part of the cart of FIG. 10*a-d,*

DETAILED DESCRIPTION OF EMBODIMENTS

Figure 1:
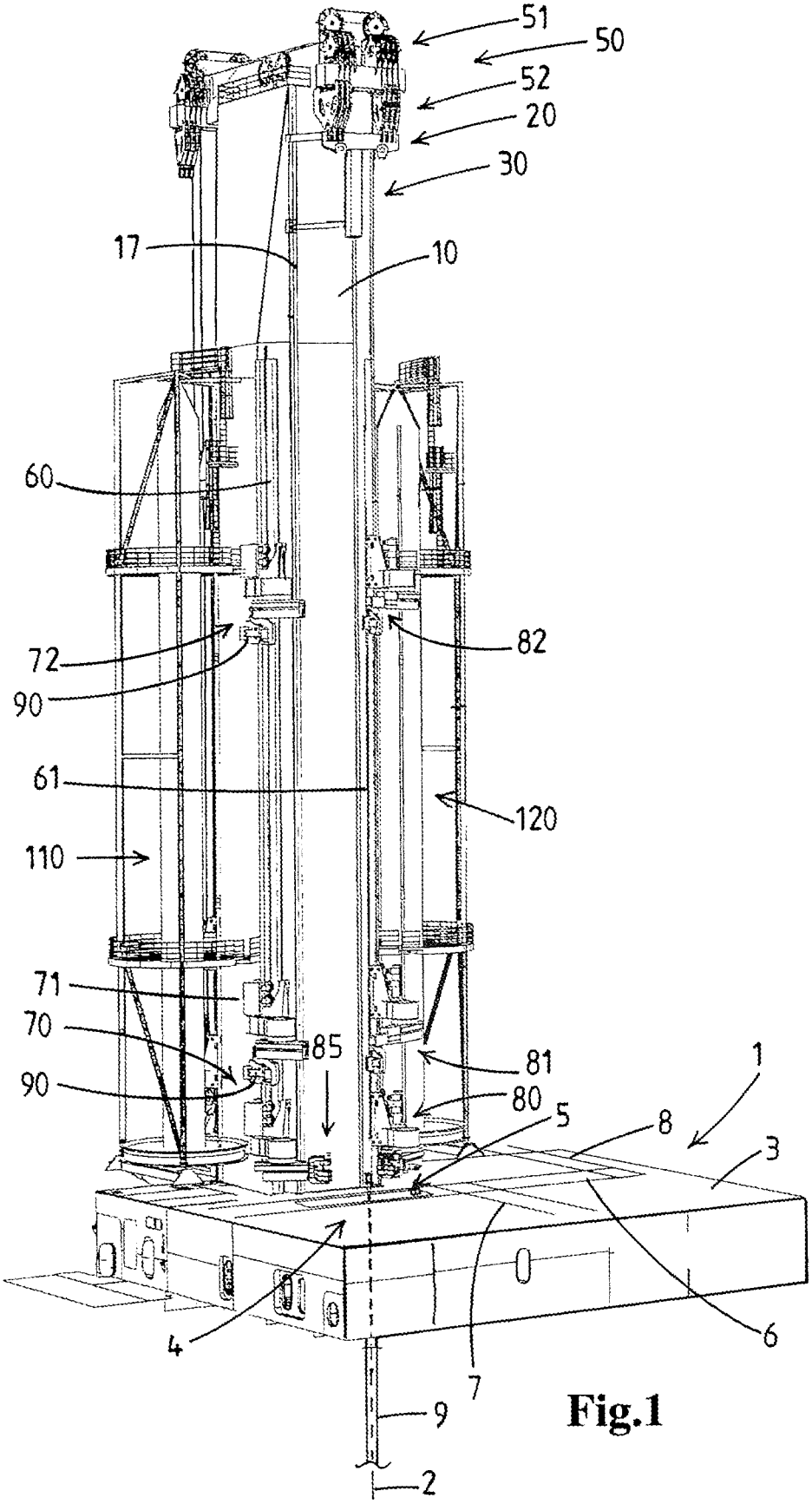
FIG. 1 shows a part of an offshore vessel for use in a wellbore activities according to the invention with a mast, trolley, vertical rails on the mast, multi-joint tubular stand storage racks, a rig floor, a moonpool, rig floor skid rails, etc.
Figure 2:
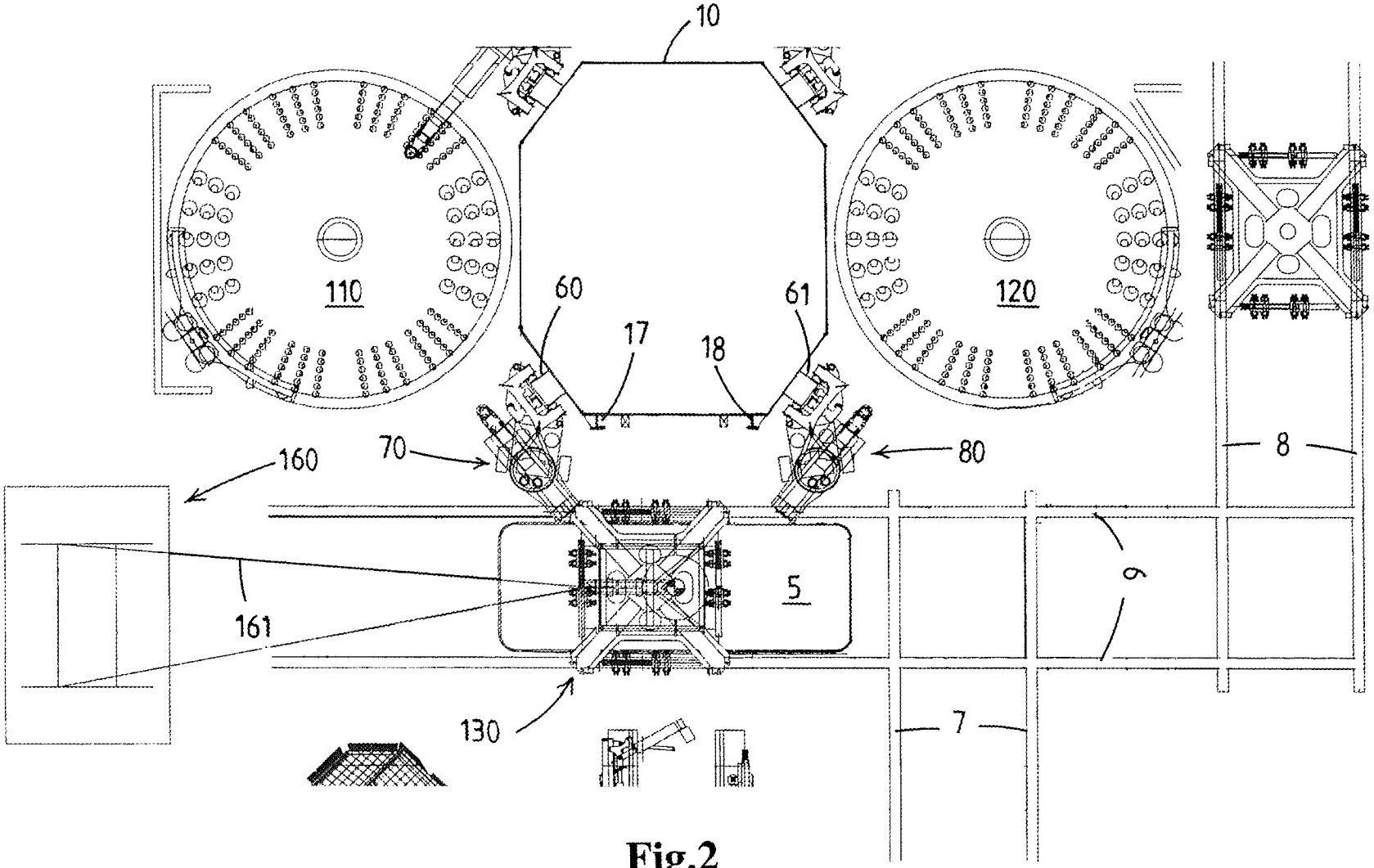
FIG. 2 shows a plan view of the vessel of FIG. 1 with the in-riser landing string assembly cart and tower in deployment location.
Figure 3:
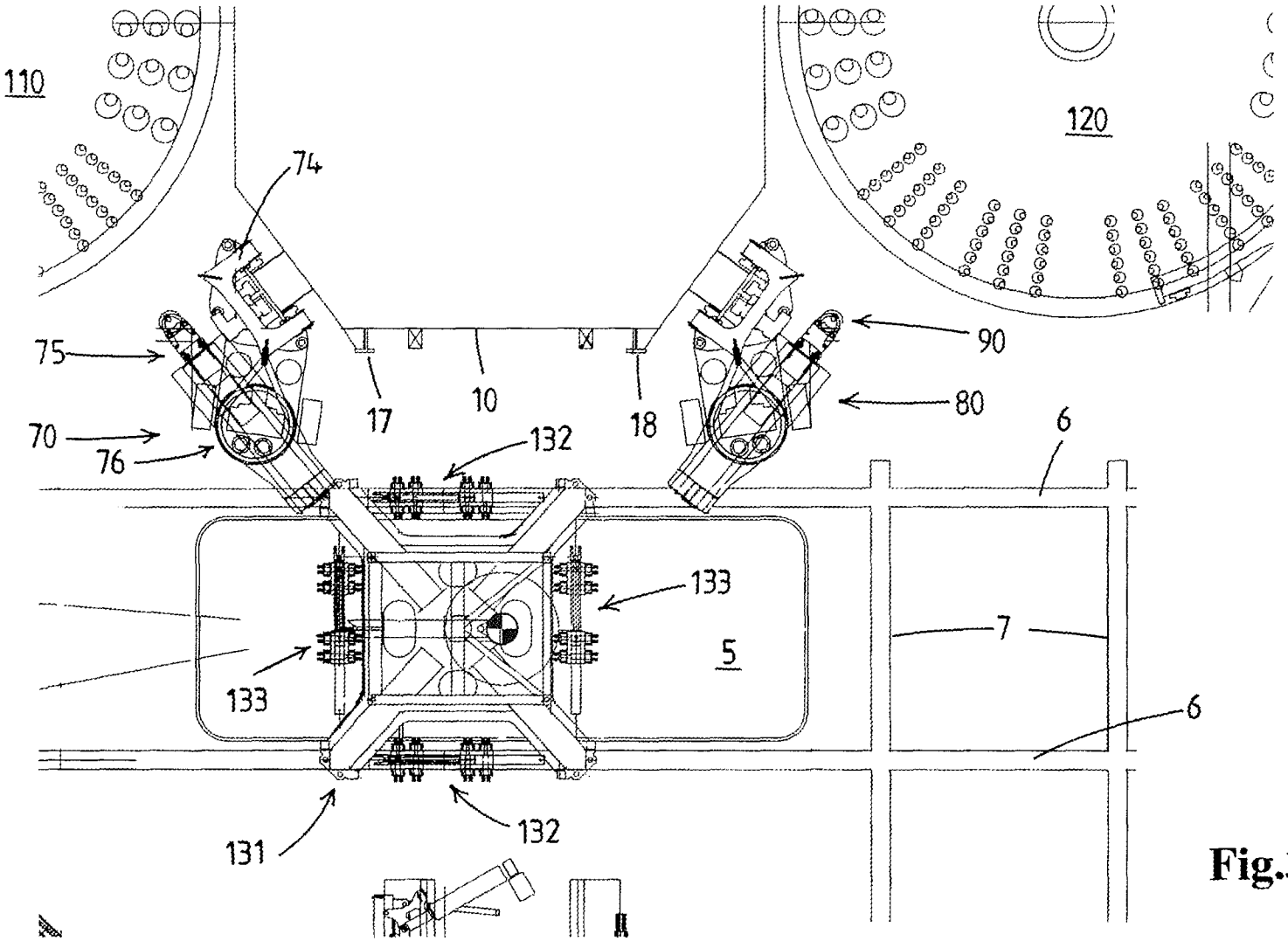
FIG. 3 shows the a part of the plan view of FIG. 2 on a larger scale.

FIG. 1 shows a part of the hull 1 of an offshore vessel. It is envisaged that the depicted offshore vessel is adapted for performing offshore drilling and/or other wellbore related activities, e.g. well completion, well intervention, etc.

Here it is illustrated that the vessel is a monohull vessel having a moonpool (inside the depicted part) through which imaginary firing line 2 extends to the subsea site of a subsea wellbore, where a well head is provided with subsea equipment like a subsea tree and/or Blow Out Preventer (BOP) stack or the like.

The depicted part has a deck 3 and a rig floor or drill floor 4 that is, as preferred, flush with the deck 2. The rig floor 4 has a well center 5, here recessed to receive therein one or more slip devices as will be explained.

On the deck 3 and over the rig floor 4 pairs of parallel skid rails 6,7,8 extend, with the rails 6 extending over the deck 3 as well as over the rig floor 4 and on opposite sides of the well center 5. The rails 7, 8 are orthogonal to the rails 6, for example as shown here the rails 6 being transverse to the elongated hull of the vessel and the rails 7, 8 extending in longitudinal direction of the hull.

As is known in the field a marine riser 9 extends between the vessel and the subsea equipment, e.g. the vessel having a riser tensioner system that engages the top portion of the marine riser.

FIG. 1 shows a mast 10 that is here embodied with a closed contoured steel structure with the firing line 2 outside of the mast 10 itself.

Here the mast 10 is arranged adjacent the moonpool.

In another, less preferred embodiment due to the envisaged height of the support tower and the in-riser landing string assembly or assemblies to be handled in conjunction with the present invention, the mast 10 could be replaced by a derrick that is placed over the moonpool, so that the firing line 2 extends within the framework of the derrick.

Other arrangements, e.g. with the mast 10 arranged over an elongated moonpool to form two moonpool areas, e.g. front and aft of the mast 10, are equally known and advantageous in conjunction with the present invention.

Figure 5:
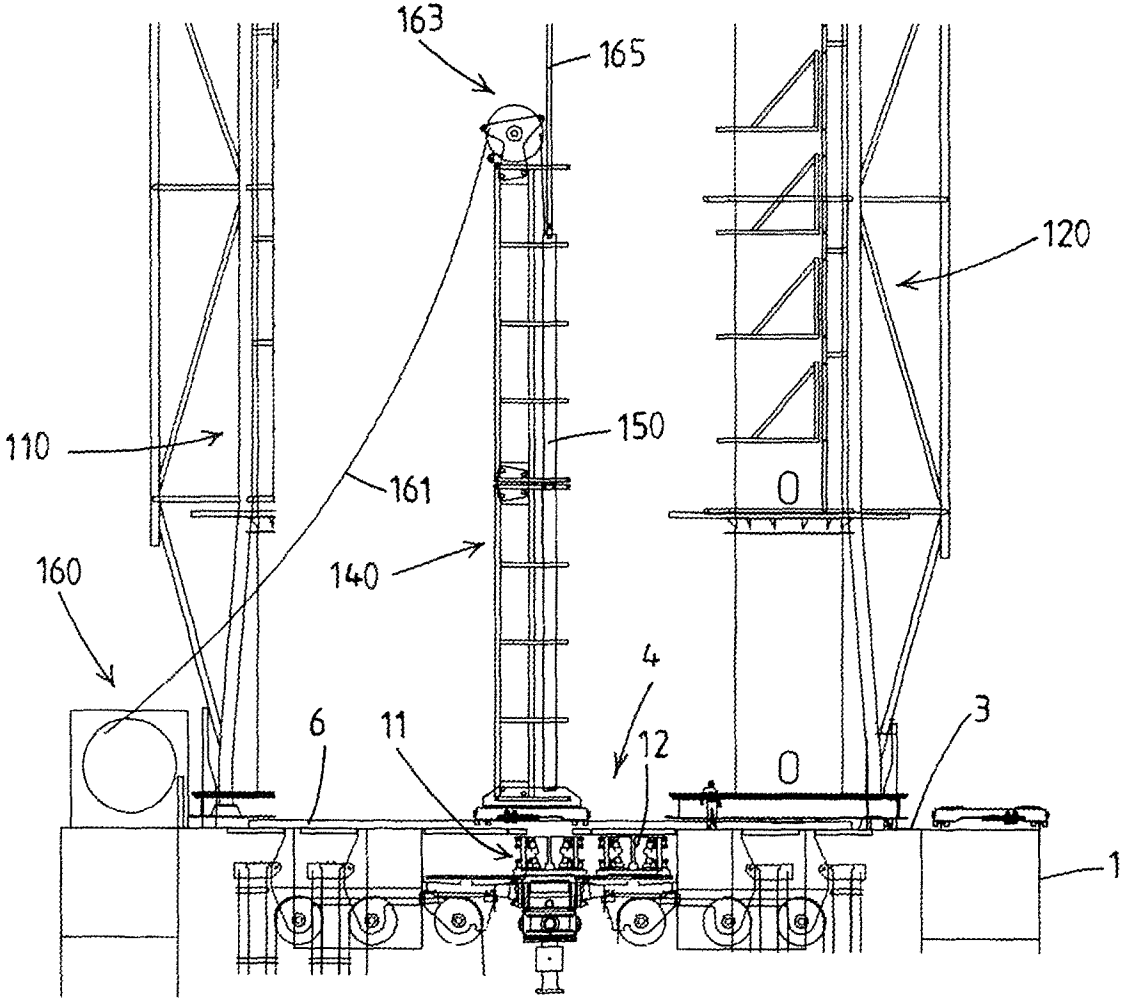
FIG. 5 shows a cross section of a part of the vessel of FIG. 1 with the in-riser landing string assembly cart and tower in deployment location and with a complete in-riser landing string assembly as well as a landing string tubing joint and umbilical connected thereto.
Figure 6:
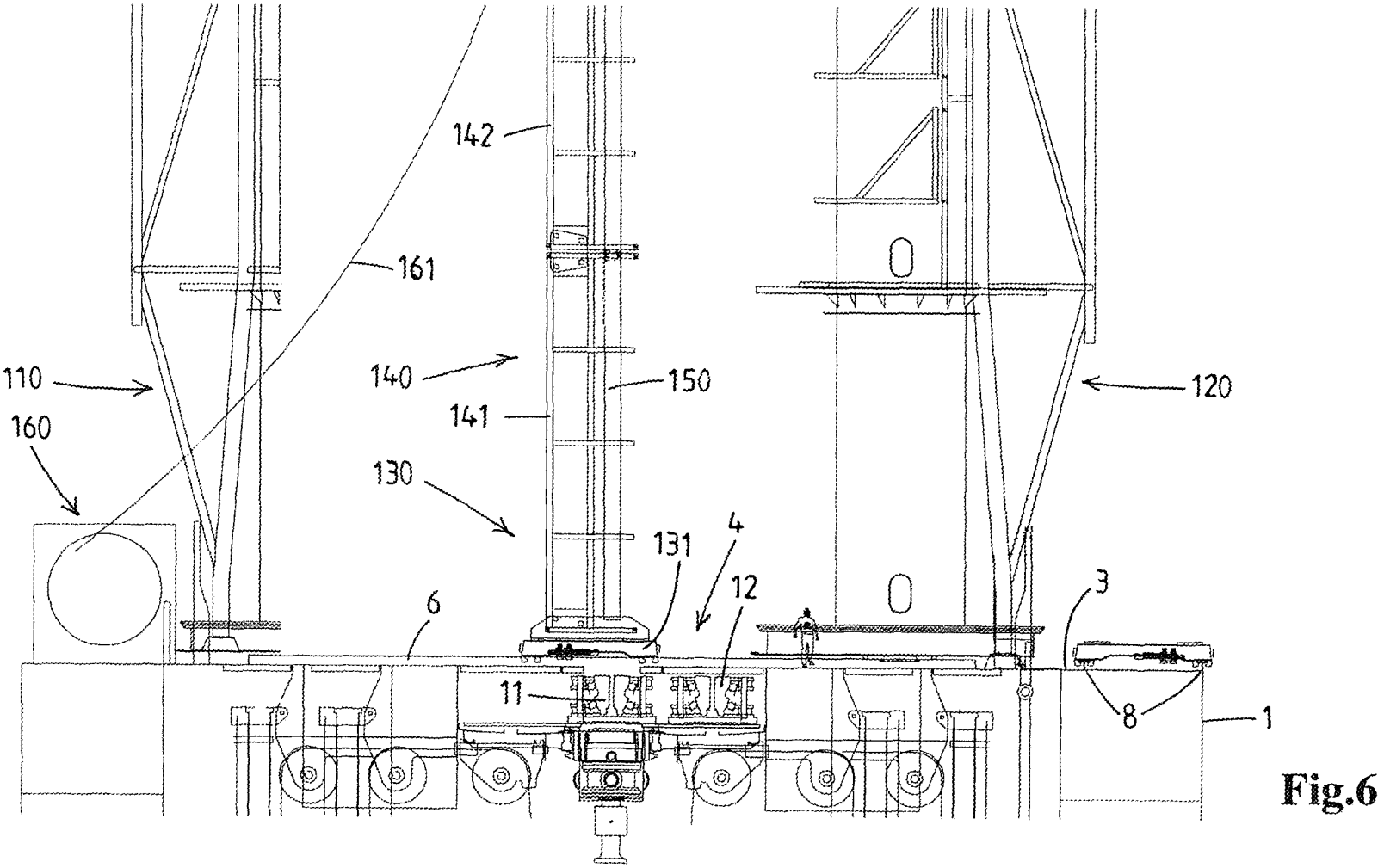
FIG. 6 shows on a larger scale a part of the view of FIG. 5.

As illustrated in FIGS. 5 and 6 one or more slip devices 11, 12 can be arranged at or near the well center. These figures show two such slip devices 11, 12 in a sunken compartment below the surface of the rig floor 4. The slip devices 11, 12 are movable, e.g. skiddable between opposed parking positions remote from the firing line and an operative position aligned with the firing line 2. As known in the art a slip device 11, 12 can retain a suspended tubular string, e.g. a landing string tubing.

The mast 10 is provided at the side of the well center 5 with two parallel vertical trolley rails 17, 18.

A trolley 20 is guided along the trolley rails 17,18.

A top drive device 30 (not shown in detail here) is releasably attached to the trolley 20. The top drive device 30 is able to impart rotary motion and drive torque to a tubulars string.

A main firing line hoisting device 50, often called drawworks, is provided and is adapted to move the trolley 20 with the top drive device 30 up and down along the vertical trolley rails 7,8. Here the hoisting device 50 comprises a crown block 51, a travelling block 52, and a hoisting cable arranged in a multiple fall arrangement between said blocks 51, 52. One or more winches of the hoisting device, e.g. arranged within or underneath the mast 10, operate the hoisting cable. These one or more winches may be heave compensated winches as is known in the art and/or one or more other heave compensation devices may be arranged to act on the cable, e.g. on the cable stretch between the one or more winches and the crown block 51 as is known in the art. This allows to move the travelling block 52, and thus the trolley 20, in a heave compensating mode.

A left-hand motion arm rail 60 and a right-hand motion arm rail 61 are present on opposed lateral sides of a vertical path of travel of the trolley 20 with the top drive device 30 along said the vertical trolley rails 17,18.

On each of said motion arm rails 60, 61 at least one, here three as is preferred, motion arm assembly 70, 71, 72, 80, 81, 82 is arranged. Each assembly is, as preferred independently controlled from any other motion arm assembly on the same rail 60, 61, vertically mobile along the respective rail by a respective motion arm assembly vertical drive.

As is preferred the assemblies 70, 71, 72, 80, 81, 82 have an identical structure. For example the assembly 71 has a base 74 that is mounted vertically mobile on the vertical rail 60.

The assembly 71 further comprises an extensible and retractable motion arm 75, here a telescopic arm with a first arm section connected to the base 74, and one or more, here two, telescopic second and third arm sections. For example the arm sections are extensible by associated hydraulic cylinders of the arm 75. The motion arm has an operative reach that encompasses the firing line 2 so that the arm can handle tubulars and/or well center equipment, or other tooling that needs to be presented or held in the firing line.

As is preferred the arm 75, here the first arm section, is connected to the base 74 via a slew bearing 76 allowing to rotate the arm about a vertical axis by means of an associated slew drive.

The assembly 70 further comprises a motion arm assembly vertical drive, e.g. with one or more motors each driving a pinion meshing with a rack that extends along the rail 60. Thereby the base 74 can move along the at least one vertical motion arm rail 60 and, for example, the drive with motor is sufficiently strong to do so while the motion arm assembly carries a load in the firing line 2 of at least 1000 kg, preferably at least 5000 kg.

At the end of the motion arm 75 a mechanical coupler part is provided. By means of the coupler part the motion arm assembly 70, here each of the depicted motion arm assemblies, is able to support at least one of a well center tool, e.g. an iron roughneck tool 85, or a tubular gripper member 90, and allowing to bring said well center tool or tubular gripper member in the firing line.

For this reason each of said tubular gripper members 90 and/or the iron roughneck tool 85 is provided with a mechanical coupler part that is adapted to be mated with the mechanical coupler part that is fitted on the motion arm 75 such that the respective gripper member, iron roughneck tool, or other well center tool, becomes fixed to the respective motion arm and fully and directly follows any motion of the motion arm.

Left and right of the mast 10 the depicted vessel has a tubulars storage rack 110, 120, here embodied as carrousels as is known in the art, adapted to store therein multi-joint tubular stands, e.g. triples, quads, or even stands of six joints, in vertical orientation therein. The tubular stands can comprises drill pipe, casing, landing string tubing, etc.

As is known in the art, by means of two or three of the motion arm assemblies 70, 71, 72, 80, 81, 82 a multi-joint tubular can be gripped by said assemblies in unison and then transferred between a storage rack 110, 120 on the one hand and a position over the well center in the firing line 2. So the motion arm assembly is, as is preferred, usable as part of a piperacker. Of course it will be possible to grip and carry one tubular joint or something similar, even when much heavier, by means of a single motion arm assembly, in particular when a single motion arm assembly would be rated to carry a roughneck device.

In an embodiment it is envisaged that a motion arm assembly, preferably provided with said synchronization functionality, is provided with a man-riding basket or cage, e.g. allowing transfer of personnel to the riser tension frame while performing a heave motion compensation motions relative to the tower 10.

The vessel is equipped with an in-riser landing string assembly cart 130, here a skiddable in-riser landing string assembly cart.

The cart 130 has a cart base 131, here a cart base configured to be skidded over the skid rails 6, 7, 8 of the vessel.

The cart 130 further has a support tower 140 erected on the cart base 131.

The cart base 131 is skiddable in two orthogonal directions over the rail system of the vessel having rails in said two orthogonal directions with a skid mechanism 132 operable to move the cart base in an X-direction and another skid mechanism 133 operable to move the cart base in a Y-direction. This allows to skid the cart 130 over the rails 6,7,8 into a deployment location above or adjacent the well center 5 of the rig floor 4.

Schematically, yet to scale, depicted in FIGS. 2-8 is an in-riser landing string assembly 150 which is arranged and retained in vertical orientation on the cart 130 with the support tower 140 providing lateral support for the in-riser landing string assembly 150. For example the assembly 150 is temporarily secured to the support tower 140 at different elevations along the height of the support tower 140 by any suitable securing members, e.g. movable clamps, rope, chain, etc.

Generally the cart 130 is configured to move over the rails 6, 7, 8, whilst retaining the assembly 150, and be stationed in various locations, including a deployment location above the marine riser 9 in the firing line 2, where the assembly 150 is deployed into the marine riser 9.

The vessel is also equipped with at least one landing string assembly umbilical winch 160, e.g. arranged or configured to be arranged adjacent the deployment location, e.g. along a side of the rig floor 4, e.g. also adjacent a testing location for the cart which is somewhat remote from the deployment location so as to keep the firing line clear allowing for other activities to be done in the firing line whilst the assembly 150 retained by the cart 130 is subjected to one or more tests.

The winch 160 has a reel onto which an umbilical 161 is wound, that is configured to be connected to the assembly 150. Testing is for example done with the umbilical 161 connected to the assembly 150 whilst the in-riser landing string assembly 150 is retained by the support tower 140 and whilst the cart 130 is offset from the deployment location, for example the testing location depicted in FIG. 8 which corresponds with the location of the cart during the descent of the landing string into the riser as also depicted in FIG. 8.

As preferred, after testing at the remote, or somewhat remote, testing location, the cart 130 and assembly 140 thereon is moved into the deployment location and during this displacement the umbilical 161 remains connected to the in-riser landing string assembly 150.

FIG. 5 illustrates that for the deployment of the in-riser landing string assembly 150 into the marine riser 9, multiple landing string tubing joints 165, e.g. as pre-assembled multi-joint landing string tubing stands, are connected to the assembly 150 and stepwise added to the landing string and so the in-riser landing string assembly is lowered down in the marine riser 9 until the subsea equipment, e.g. comprising a BOP stack, is reached where the assembly, or a part thereof, is accommodated.

Figure 8:
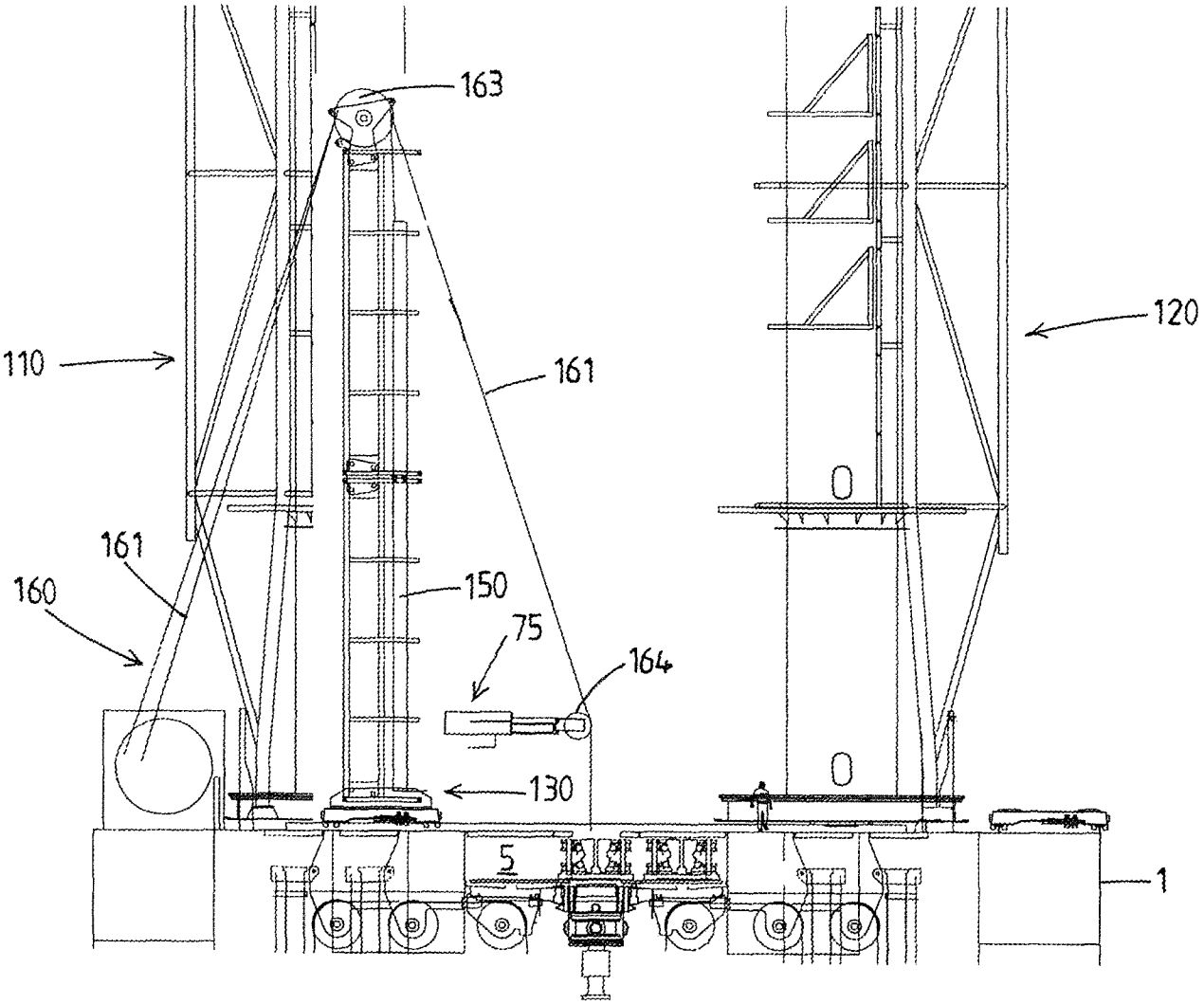
FIG. 8 illustrates that the in-riser landing string assembly cart and tower are located in a testing location somewhat remote from the deployment location, as well as the situation during deployment of the landing string into the marine riser wherein an auxiliary umbilical guide is mounted on a motion arm.

As shown in FIG. 8 it is proposed that the deployment of the landing string into the marine riser 9 is in majority done with the cart 130 and support tower 140 having been relocated or moved into an offset location, e.g. into the testing location, remote, from the deployment location. Herein the umbilical 161 passes from umbilical winch 160 over an umbilical guide 163 that is mounted on the support tower 140 on the cart. Also depicted is the use of auxiliary umbilical guide 164 for the umbilical being arranged at the deployment location, e.g. above a well center of a rig floor. Here, as preferred, the guide 164 is held by a motion arm 75.

It is envisaged that the support tower 140 has a tower height of at least 12 meters, e.g. of between 20 and 36 meters, here in FIGS. 2-9 of 24 meters (80 ft.).

Figure 9:
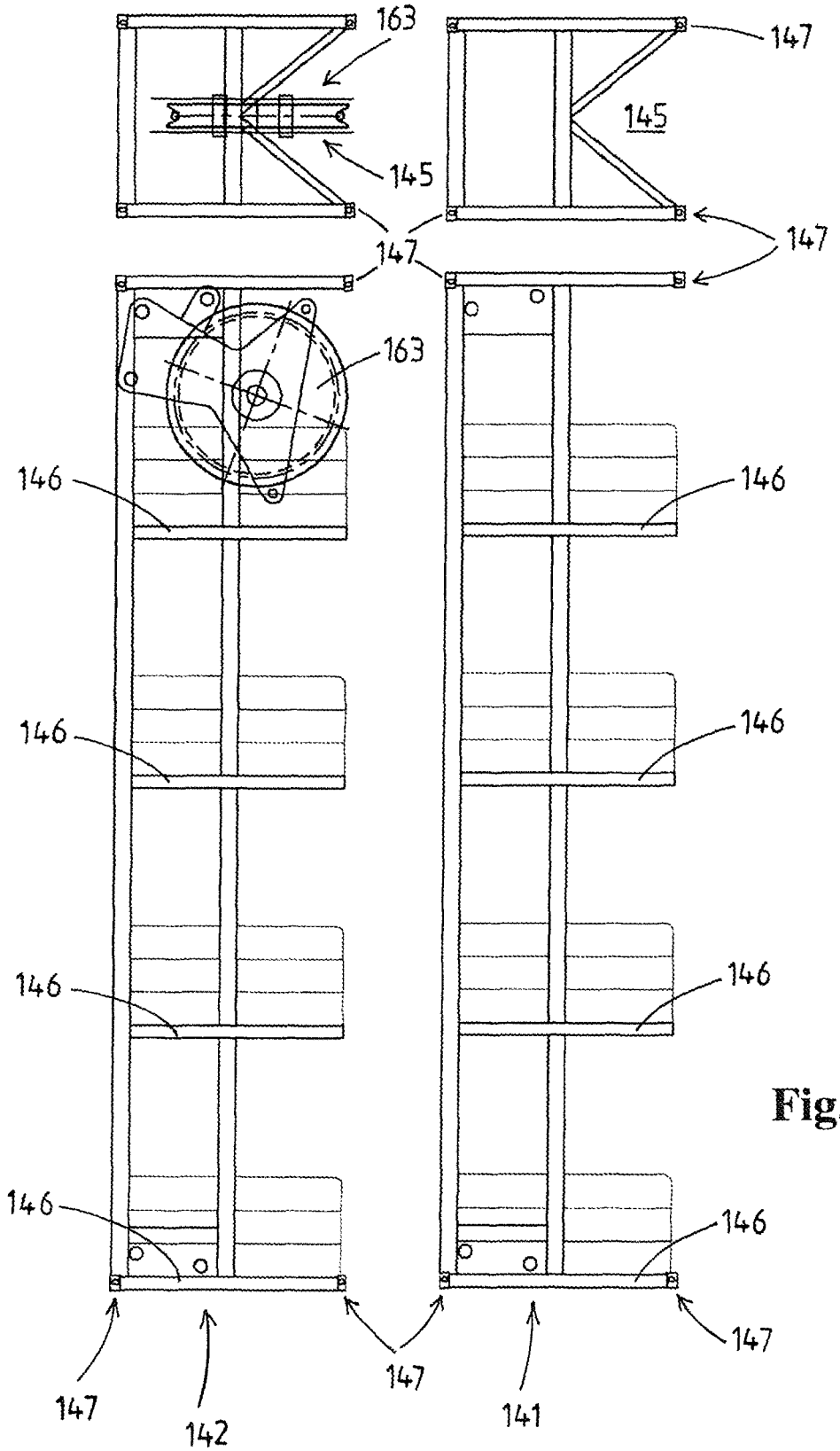
FIG. 9 illustrates the two containerized tower parts that make up the tower on the in-riser landing string assembly cart of FIGS. 1-8, FIGS. 10*a-d* illustrate another embodiment of an in-riser landing string assembly cart.
Figures 11A, 11B, 12A, 12B:
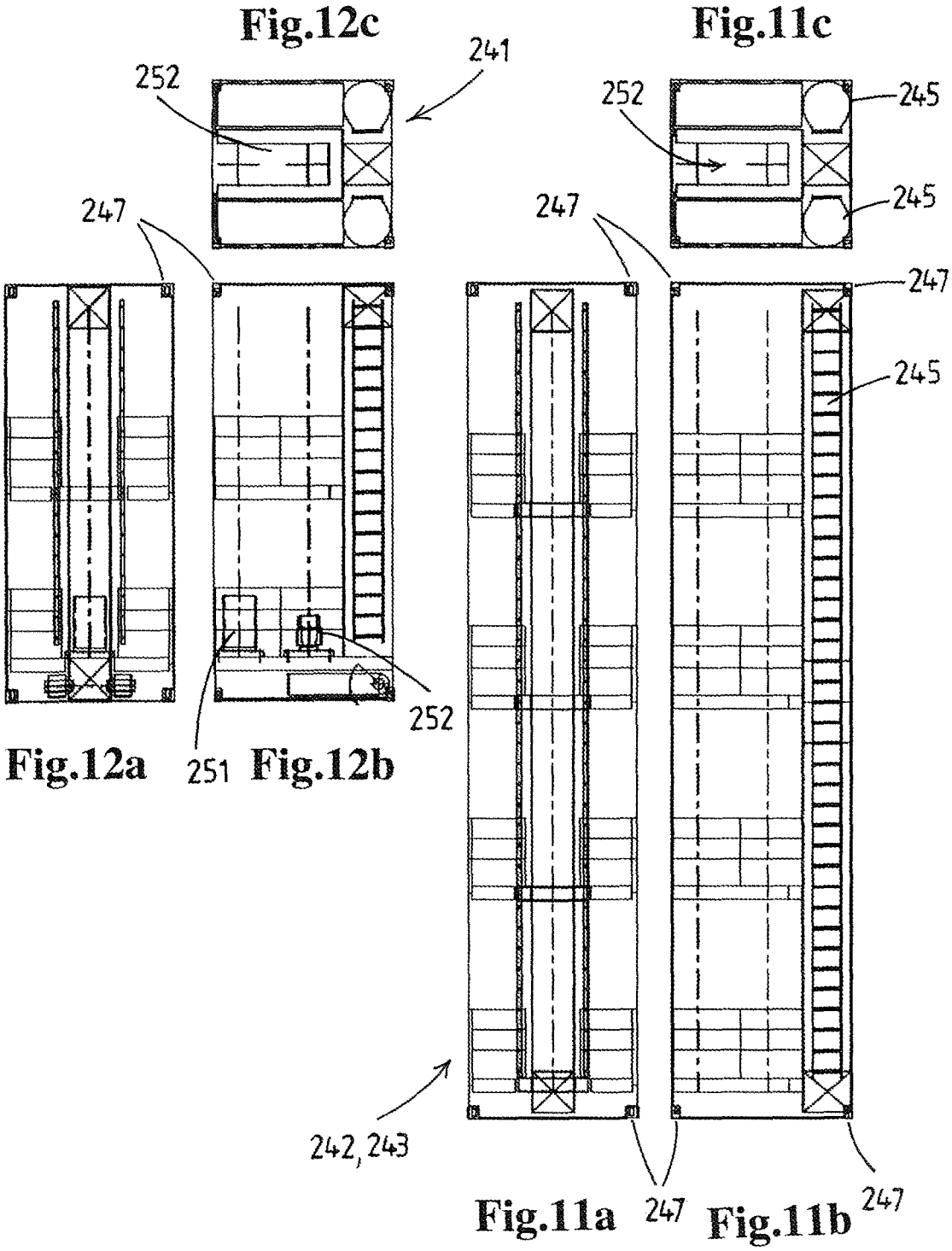

In FIGS. 2-9 the support tower 140 has two interconnected tower parts 141, 142 each having a length of 12 meters, (40 ft.). in FIG. 9 the tower parts 141, 142 are shown in side view and from above. Each tower part 141, 142 is configured for shipment and/or handling and/or storage as a 40 ft. ISO intermodal freight container.

Figure 4:
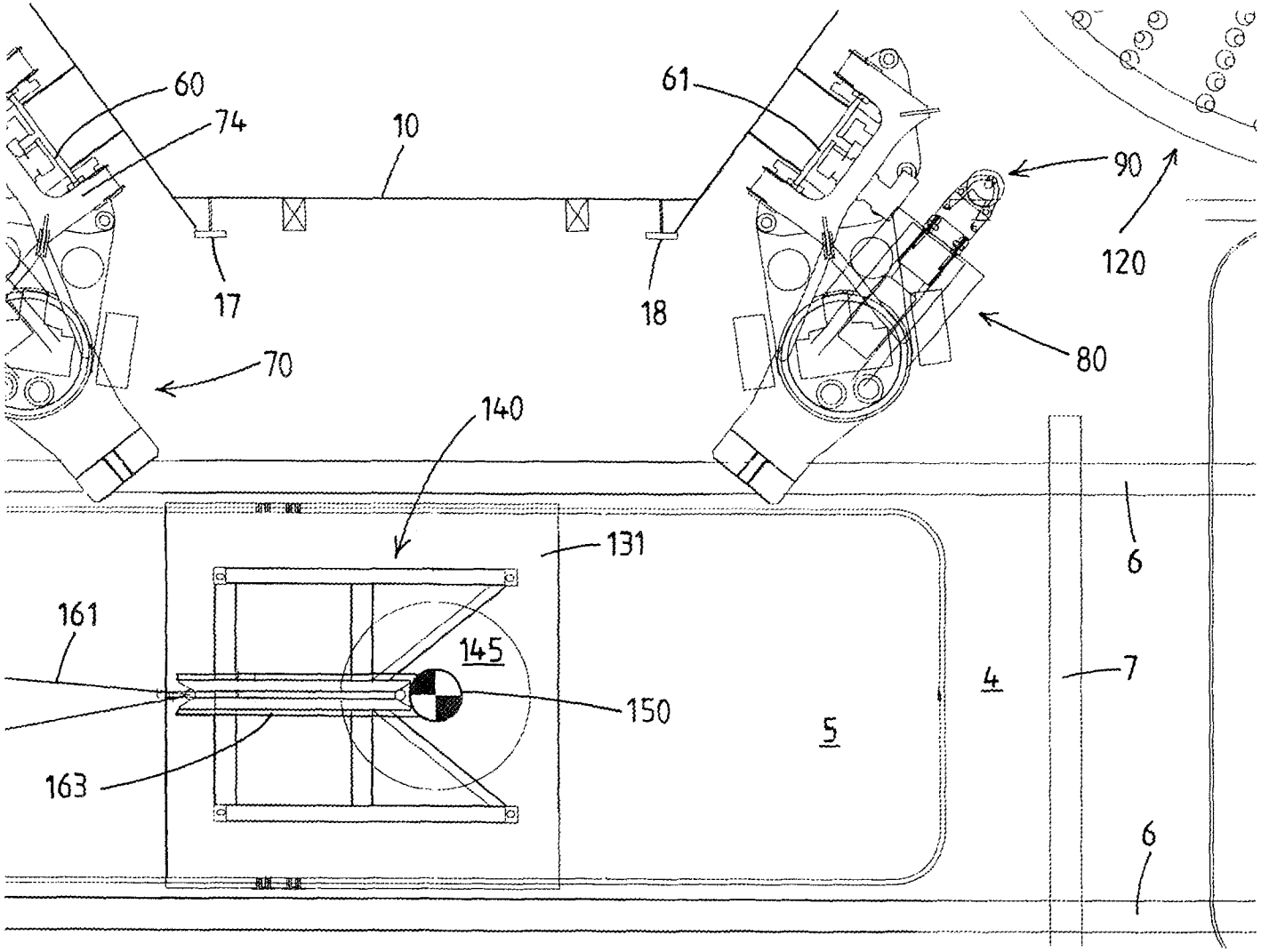
FIG. 4 illustrates the tower in the deployment position.

As can be seen in e.g. FIGS. 4, 9 the structural frame of the tower parts 141, 142 is embodied with a recessed receiving space 145 for the in-riser landing string assembly 150. This recess 145 that is open in a lateral side, e.g. in a front side, of the structural frame when in upright orientation or relative to the main longitudinal axis thereof. This lateral opening of the recess 145 may be used for the introduction and/or removal of one or more components of the landing string assembly 150, preferably the entire landing string assembly 150, and/or of a landing string tubing joint 165 and/or of a stand of multiple landing string tubing joints, in lateral direction from the outside into the recessed receiving space and vice versa.

Figure 7:
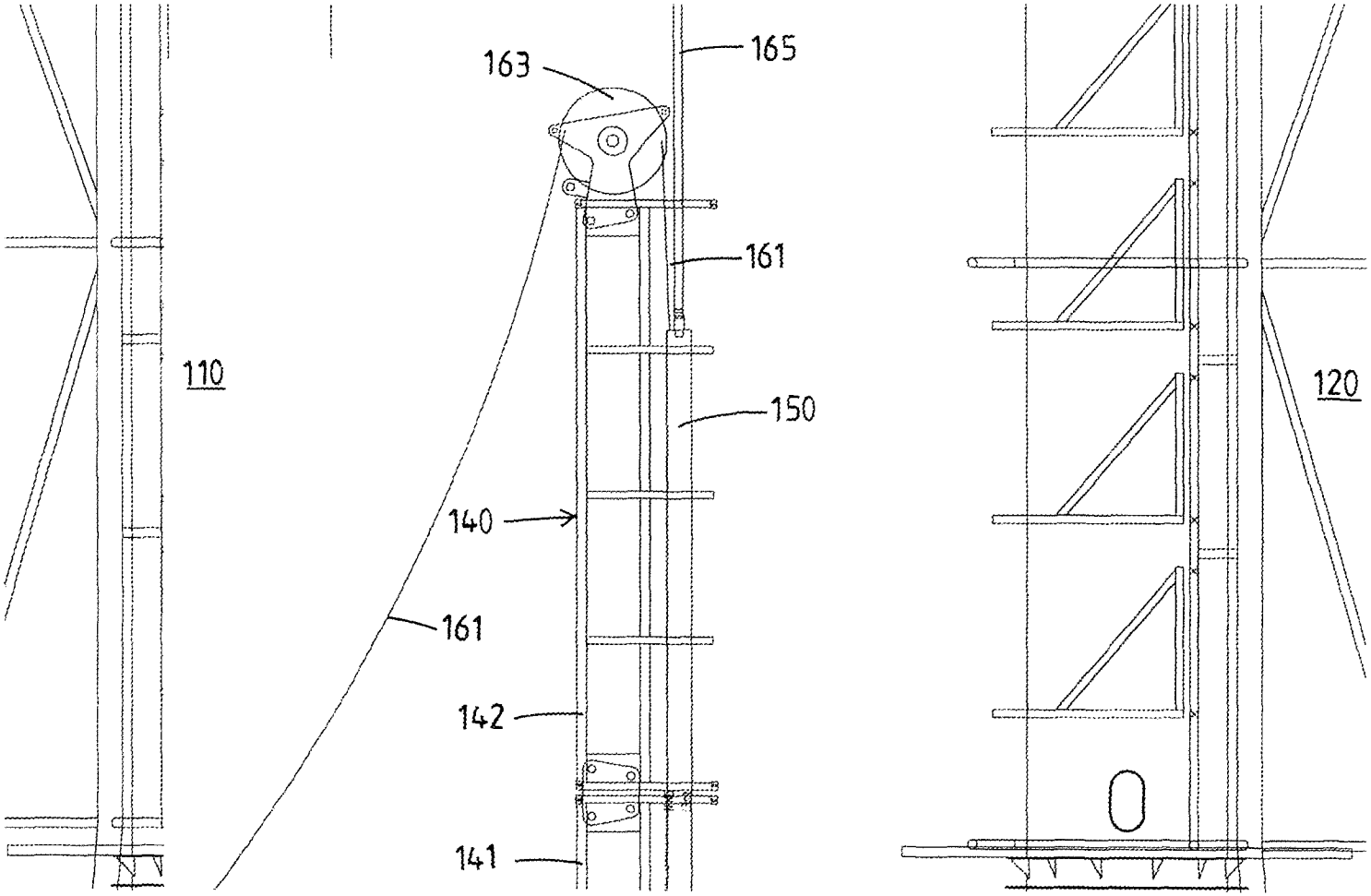
FIG. 7 shows on a larger scale another part of the view of FIG. 5.

As will be appreciated, e.g. looking at FIGS. 5 and 7, the in-riser landing string assembly 150 is transferred by means of the in-riser landing string assembly cart 130, e.g. skidded, into the deployment location above the marine riser 9 and then one or more landing string tubing joints or stands 165 are connected to a top end of the in-riser landing string assembly 150 and the in-riser landing string assembly is then suspended from these one or more landing string tubing joints or stands, e.g. using the drawworks 50, where after the cart 130 with support tower 140 is moved away and placed at a remote location, e.g. back to a testing location, as shown in FIG. 8.

With the cart 130 and support tower 140 moved to a location remote from the deployment location, the in-riser landing string assembly is lowered until the landing string tubing passes through a slip device 11, 12 and this slip device is then made to engage on the landing string tubing, followed by stepwise lengthening of the landing string by adding landing string tubing joints or stands, e.g. until the assembly is lowered sufficiently, e.g. is landed onto a tubing hanger of the subsea equipment.

FIG. 9 depicts that the tower parts 141, 142 include platforms 146 and corresponding railings at different heights so as to facilitate access of personnel to the assembly 150 retained by the support tower.

FIG. 9 depicts that the tower parts 141, 142 include at axial ends thereof ISO container corner fitting members 147 that allow for handling of the parts as freight containers and may also be of use for interconnecting the parts 141, 142 to one another and/or to the cart base 131.

FIG. 9 illustrates that the guide 163 can be stored within the contour of a tower part 142, e.g. for reduced space during storage and/or shipping. Here the guide 163 is pivotally connected to the tower part 142.

With reference to FIGS. 10*a-d* now another embodiment of an in-riser landing string assembly cart 230 will be discussed.

As the cart 130 the cart 230 is comprised of a cart base 231, which may be of the same structure as discussed with reference to cart base 131, and a support tower 240.

FIG. 10*a* shows the cart base 231 on the rails 6 over the well center 5. There above, disconnected from the cart base 231 the tower 240 is depicted.

It will be appreciated that the depicted tower 240 is even taller than the tower 140, namely an extra 20 ft. or 6 meters for the third part and, as preferred, some extra height due to intermediate tower parts between the containerized parts 241, 242, 243, so a total height of more than 30 meters (100 ft.).

The tower 240 is composed here mainly of three tower parts 241, 242, and 243. Herein the parts 242 and 243 are 12 meters, 40 ft., long, and the part 241, here the lower part, is 6 meters, 20 ft. long.

Each of the parts 141, 142, 143 is provided with platforms 244, e.g. every 3 meters (10 ft.), railings, and with ladders 245 to gain access to the tower 240.

FIGS. 10*a-d* depict that the tower parts 241, 242, 243 include at axial ends thereof ISO container corner fitting members 247 that allow for handling of the parts as freight containers and may also be of use for interconnecting the parts 241, 242, 243 to one another and/or to the cart base 231. Here, intermediate short length tower parts 248 are placed between the parts 241, 242 and between parts 242, 243 respectively.

The FIGS. 10*a-d* also illustrate that the tower 240 is embodied to retain two in-riser landing string assemblies simultaneously in side by side arrangement. This is foreseen to deal with operations that require very long assemblies to exceed a practical maximum height of the cart and support tower. For instance assemblies having a length of more than 30 meters.

In FIGS. 10*a-d* two assemblies 151 and 152 are schematically shown, with assembly 151 being a lower assembly 151 and assembly 152 being an upper assembly that is configured to be secured on top of the lower assembly 151 during the deployment process.

In FIGS. 11*a*-11*c* and 12*a-c* the tower parts 241, 242, (with 243 being the same as 242) are shown in more detail. Here it is also illustrated that the tower part 241 may be provided with a stub 250, 251 or the like to receive and support the lower end of the respective assembly 151, 152.

The FIGS. 11*a-c*, 12*a-c*, also illustrate that the structural frame of the tower parts 241, 242, 243 is embodied with a recessed receiving space 252 for the in-riser landing string assemblies 151, 152. This recess 252 that is open in a lateral side, e.g. in a front side, of the structural frame of the entire tower 240 when in upright orientation or relative to the main longitudinal axis thereof. This allows e.g. to skid the cart 230 with tower 240 away from the deployment location once an assembly 151 has become suspended and lifted from its stub.

Figure 13:
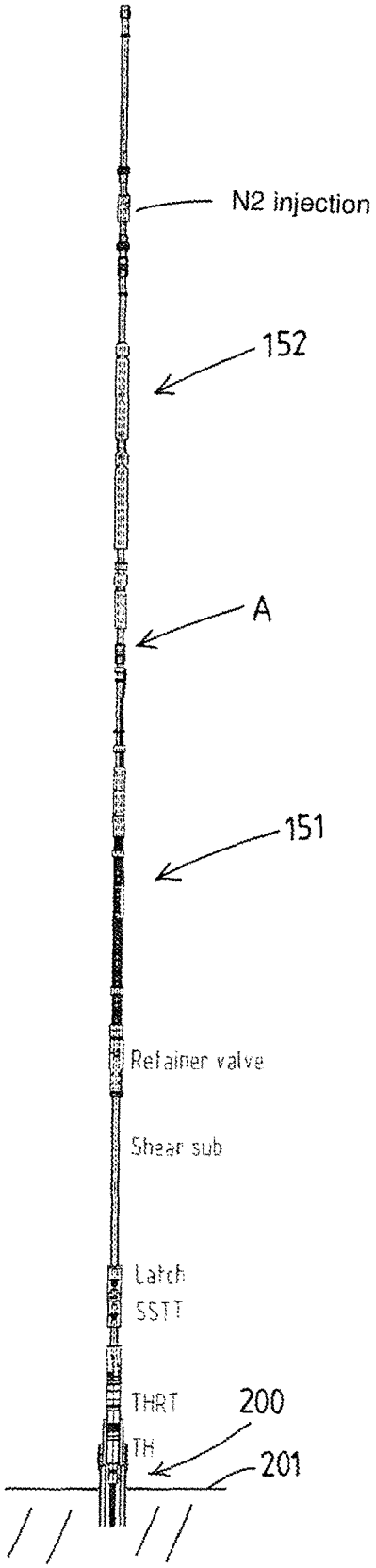
FIG. 13 illustrates the combined lower and upper assemblies when lowered.

FIG. 13 schematically depicts the combined assemblies 151, 152 joined at A during the deployment procedure onboard the vessel after the landing string has been lowered to the level of the equipment on well head 200 on seabed 201. As can be seen, in this example, the lower assembly 151 comprises components like the SSTT component, latch mechanism component, shear sub component, and retainer valve component, as well as (at the lower end) the THRT component. As discussed the composition of the assembly may be varied according to the specific requirements. Here the upper assembly in particular comprises an N2 injection component, e.g. in view of gas lift functionality. The combined assembly 151, 152 is very tall and therefore the handling as two (or more) pre-assembled assemblies by means of one or more carts 130, 230, is advantageous.

Figure 14:
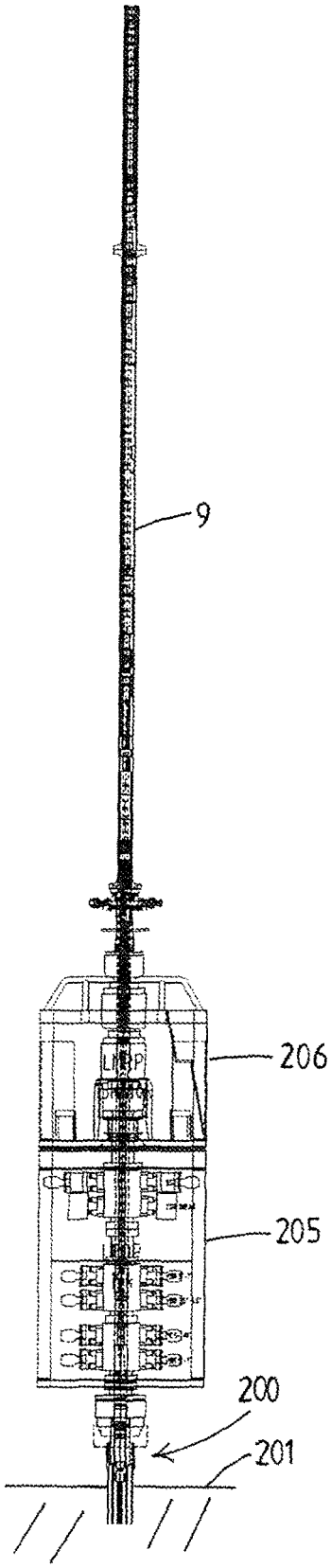
FIG. 14 illustrates the combination of FIG. 13 with the riser and subsea equipment on the well head.

FIG. 14 schematically depicts this combined assemblies 151, 152 with the lower end of the marine riser 9 and with the subsea equipment on the well head 200. Here a BOP stack 205 is provided as well as a further subsea tool 206 stacked thereon. It can be seen that shear rams of the BOP are at the level of the shear sub. It is also shown that the THRT has been landed on the TH or tubing hanger.

Figure 15:
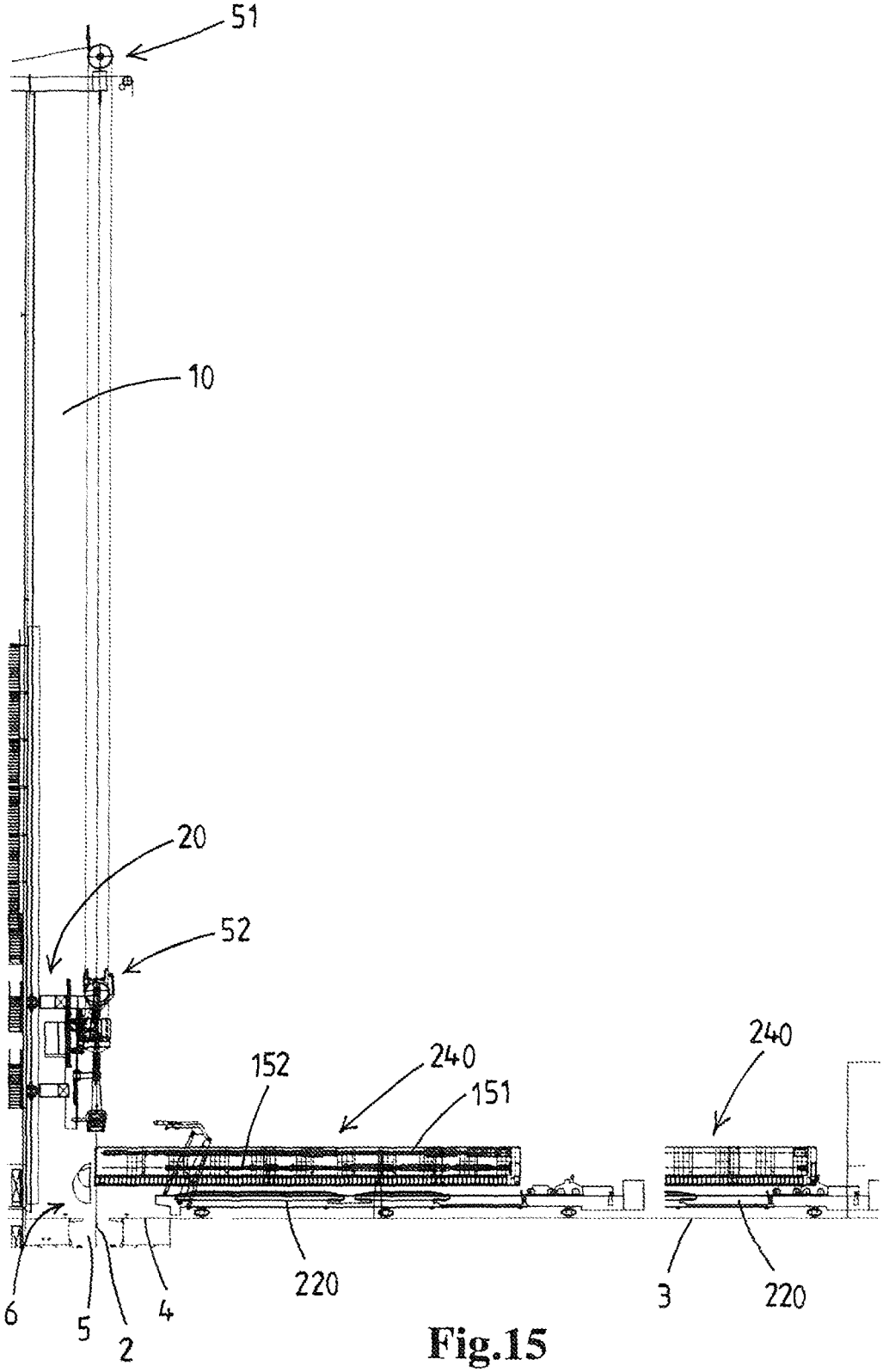
FIG. 15 illustrates the handling of assemblies with the support tower as a unit on a catwalk machine.

FIG. 15 schematically illustrates that the support tower 240 with the one or more assemblies 151, 152 retained thereby, has served for the purpose of storage of said one or more assemblies 151, 152 in horizontal orientation, e.g. somewhere on deck or in a hold, e.g. riser storage hold, of the vessel.

Once use of the assemblies 151, 152 is envisaged, the entire unit of tower 240 and assemblies 151, 152 is in this example placed on a catwalk machine 220 of the vessel, e.g. the catwalk machine commonly used for handling riser and/or tubulars. The catwalk machine 220 is then advanced towards the mast 10, e.g. as shown so that the front (or later upper) end of the support tower 240 is underneath the drawworks 50, here trolley 20. Then this end is secured to the drawworks, here to the trolley 20 for the procedure of upending this entire unit of support tower 240 and one or more assemblies 151, 152.

Figure 16:
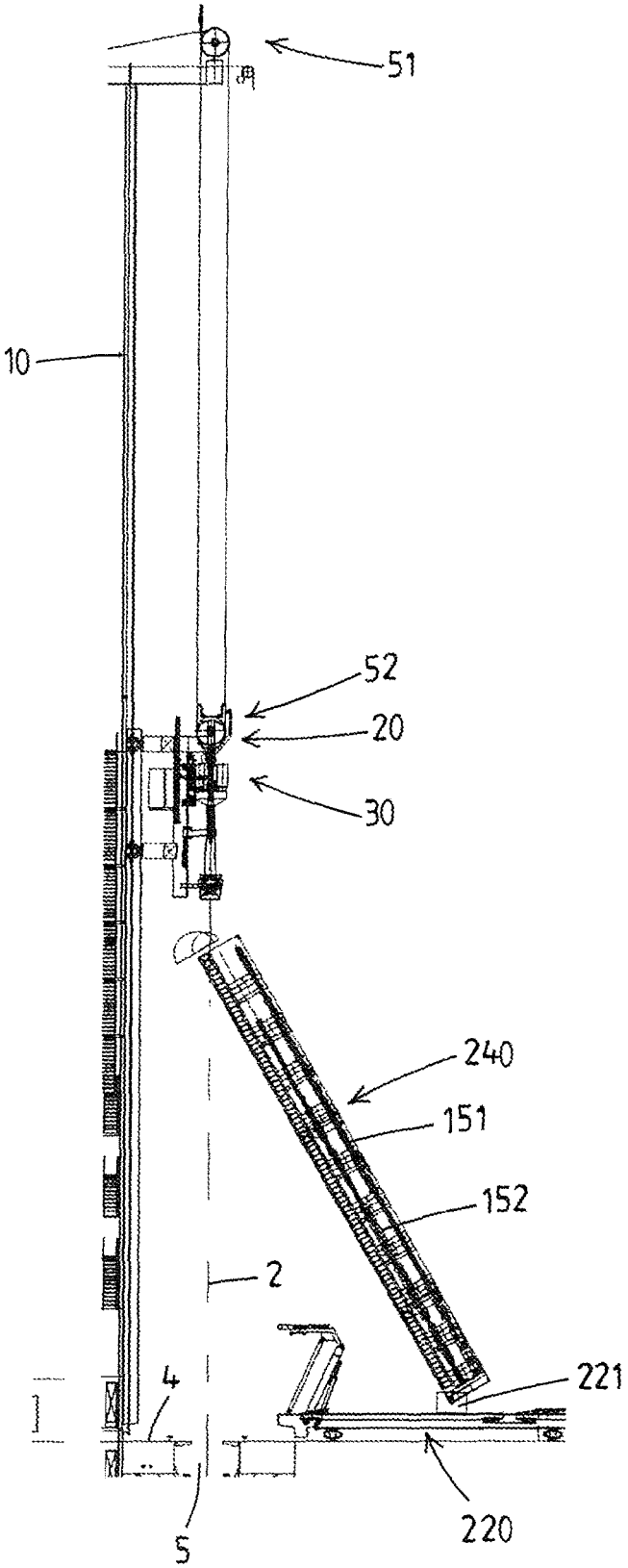
FIG. 16 illustrates the upending of the unit of FIG. 15.

FIG. 16 schematically illustrates that the support tower 240 with the one or more assemblies 151, 152 retained thereby is upended as a unit using the drawworks 50, here with the catwalk machine 220, e.g. the skate 221 thereof support the lower end of the unit during the upending procedure.

Figure 17:
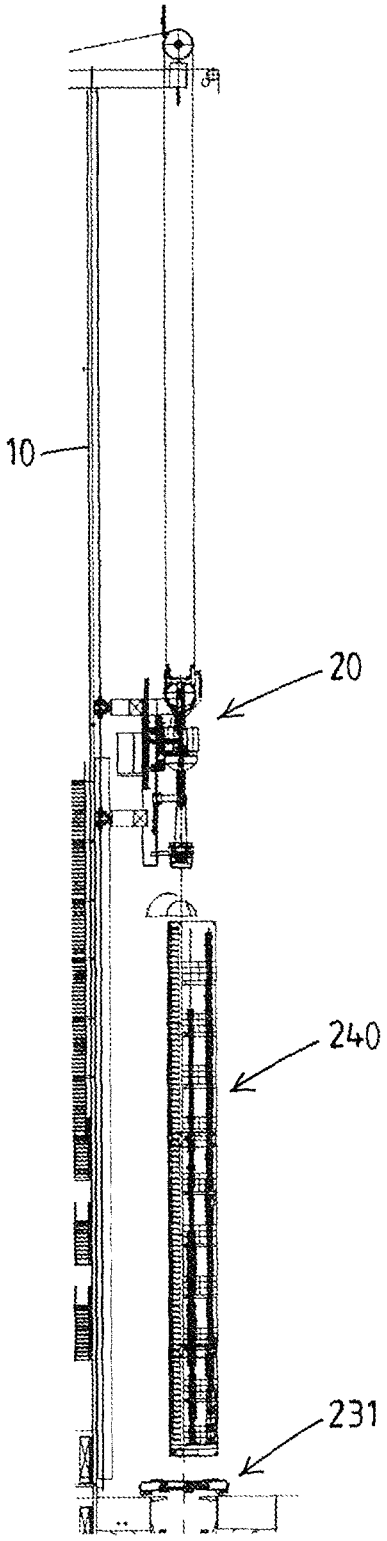
FIG. 17 illustrates the unit being upended and suspended from the drawworks.

The FIG. 17 illustrates that the unit of support tower 240 and retained assemblies 151, 152 has been completely brought into vertical orientation using the drawworks. Also the cart base 231 has been brought into position below the suspended unit in advance of the mating of the unit and the cart base 231.

Figure 18:
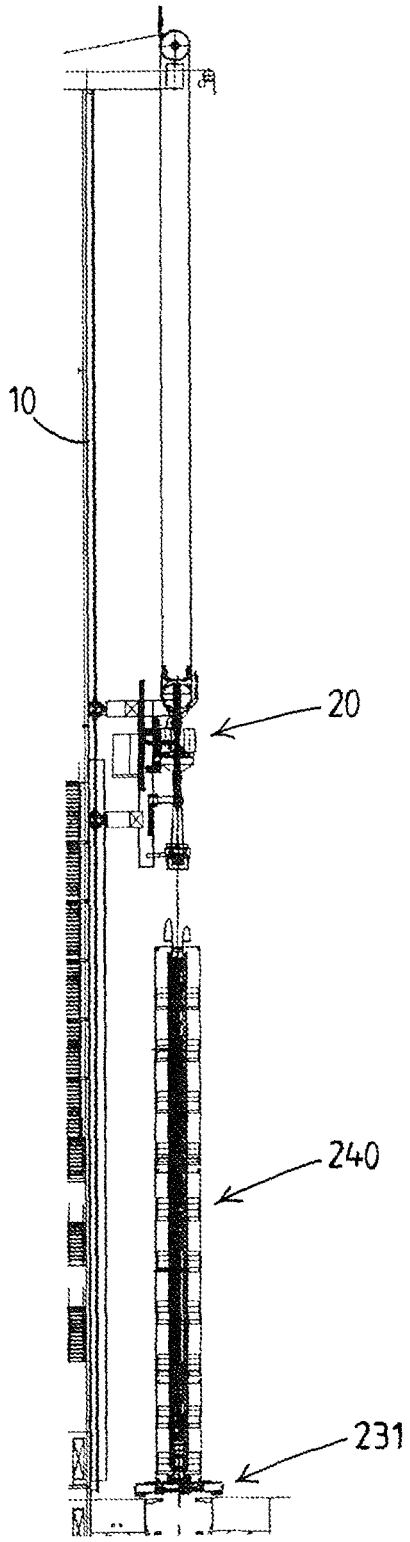
FIG. 18 illustrates the lowering of the unit onto the corresponding cart base.

FIG. 18 depicts that the unit has been lowered or otherwise arranged on the cart body 231 and properly secured thereto, e.g. using pins, bolts, or other securing or fastening members. Now the tower 240 with assemblies 151, 152 can be skidded away from this location, that corresponds to the deployment location, e.g. to a remote testing location, e.g. some 5 to 15 meters over rails 6.

Figure 19:
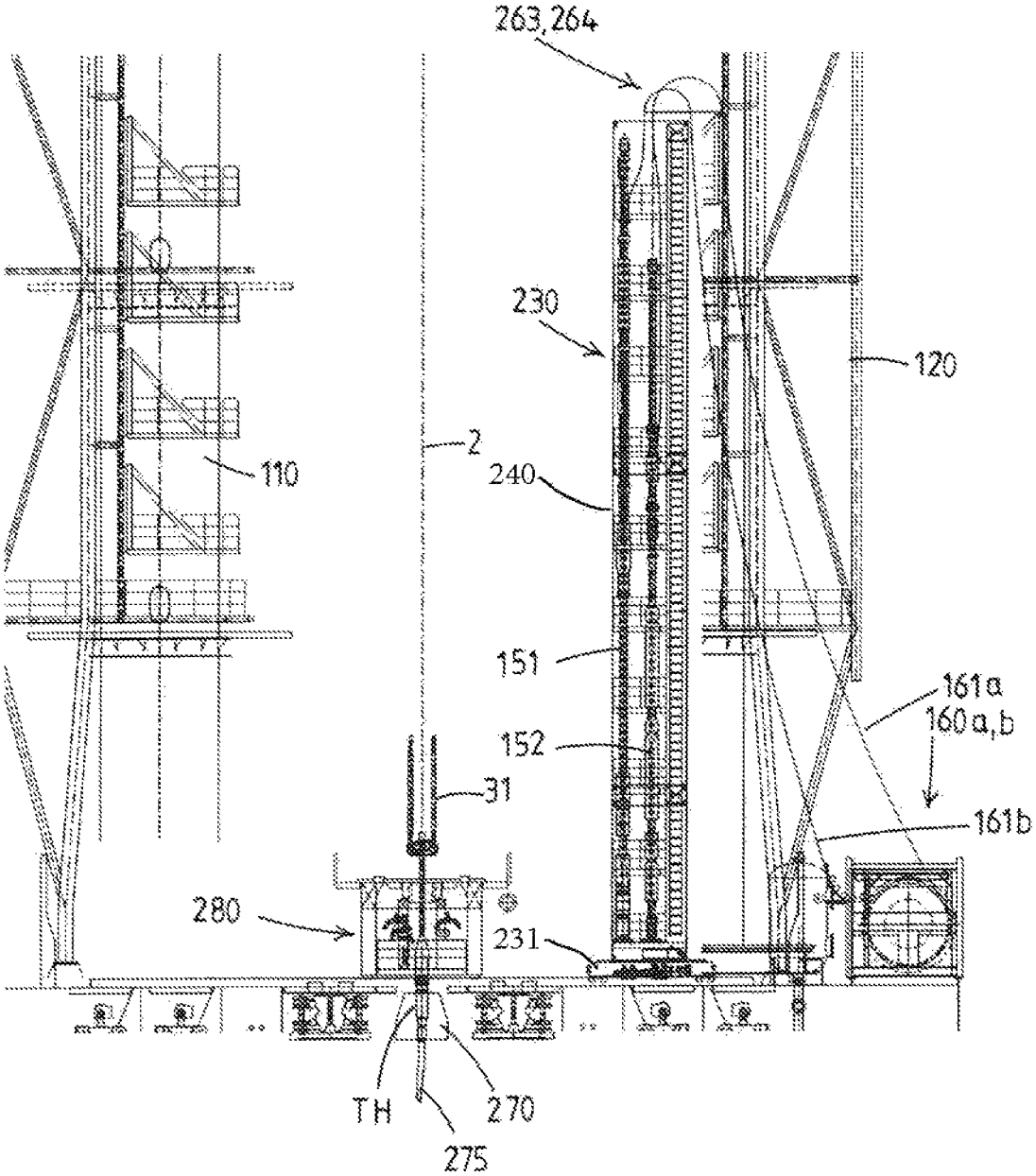
FIG. 19 illustrates the testing of the assemblies whilst other activity is performed at the well center.

FIG. 19 illustrates the cart 230 with assemblies 151, 152 being located at a testing location, remote from the deployment location in the firing line 2. Also shown are two umbilical winches 160*a, b*, each with an umbilical 161*a, b*.

Herein umbilical 161*a* is connected to assembly 152 and umbilical 161*b* to assembly 151.

As shown the tower 240 has guides 263, 264 for each of the umbilicals.

It will be appreciate that testing can now be done, with umbilicals 161*a, b* connected to the respective assembly 151, 152 whilst the firing line 2 is clear and functional for other activities, e.g. lower production tubing 275 into the well via the marine riser 2 using the drawworks 50. This is depicted in FIG. 19 where the stage has been reached that the production tubing hanger TH is held at the level of the rig floor 4, e.g. by a support device 270 placed between the slip devices 11, 12.

The FIG. 19 depicts that the process of lowering the production tubing 275, and attaching one or more control lines to the exterior thereof, has been done using a lower frame section 280 of a riser tension frame 290 as discussed in detail in co-pending NL 2018018 which is incorporated herein by reference.

Figure 20:
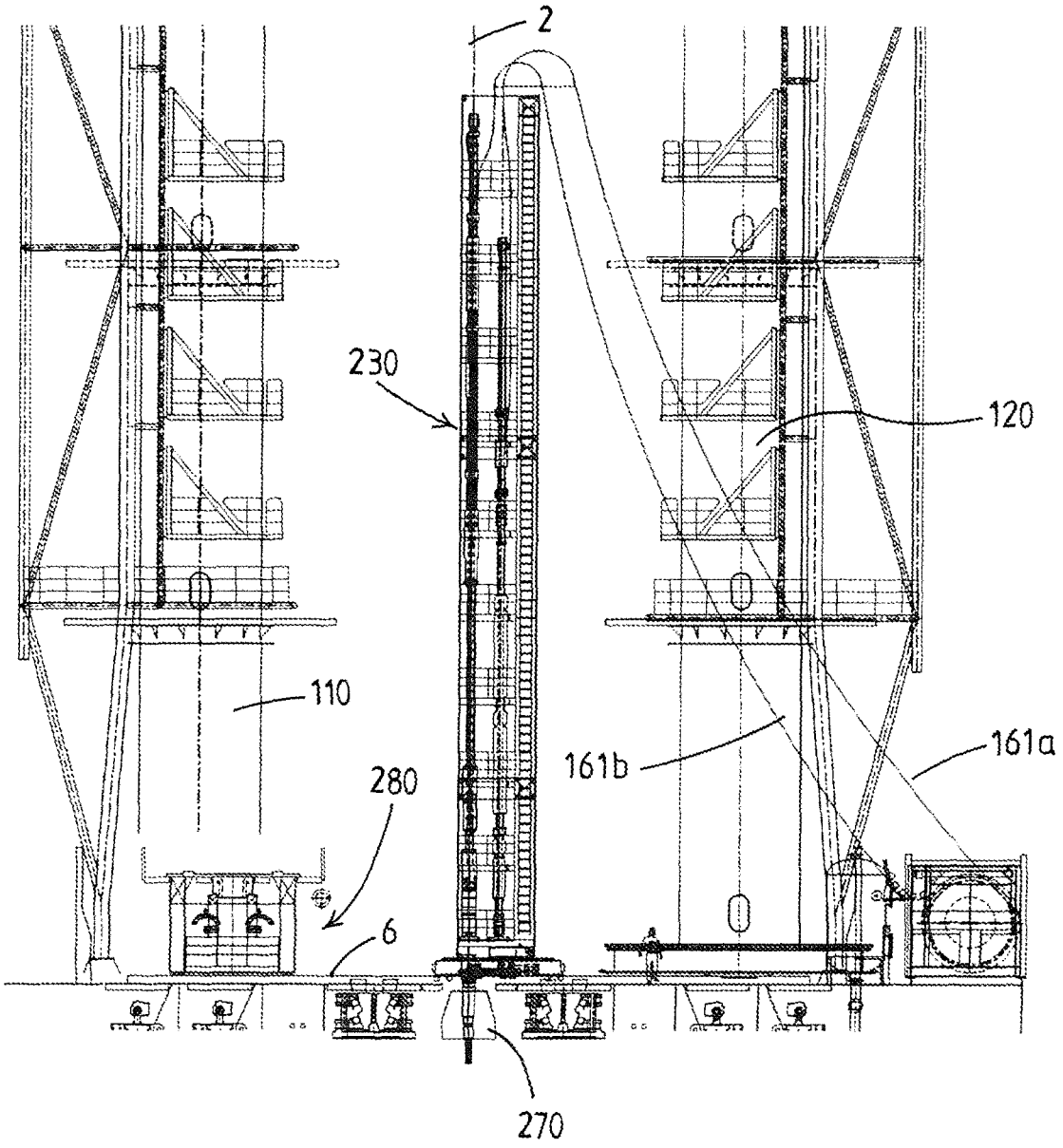
FIG. 20 illustrates the placing of the cart in the deployment location.

FIG. 20 illustrates the transfer of the cart 230 and the assemblies 151, 152 to the deployment location over the well center 5, here so that lower assembly 151 is aligned with the firing line 2 and the drawworks 50. This shift from the testing location to the deployment location is done with the one or more umbilicals 161*a, b* remaining connected. The lower frame section 280 has been shifted, also using a skid arrangement over rails 6 to the other side.

Figure 21:
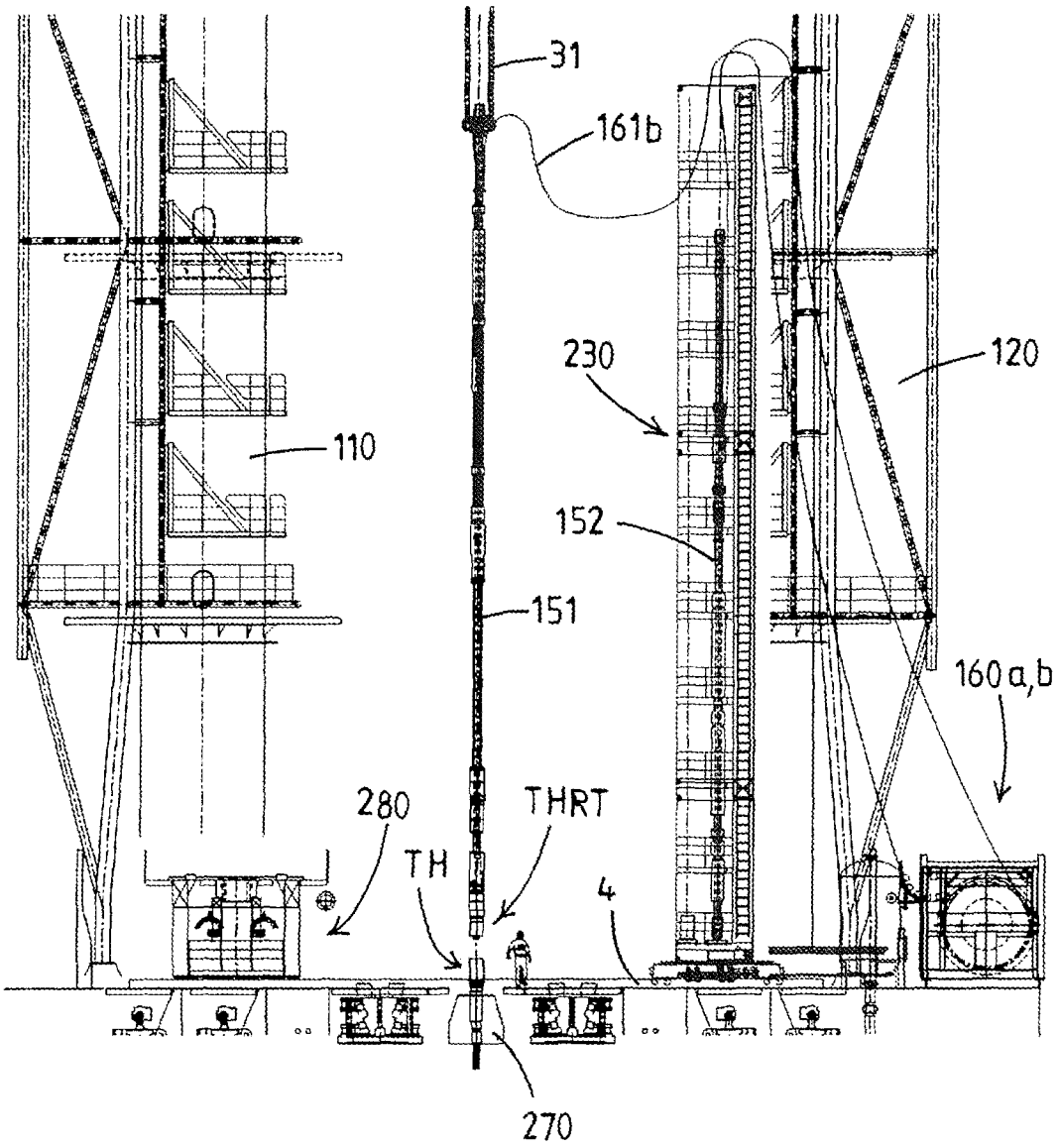
FIG. 21 illustrates the handling of the lower assembly whilst the cart with upper assembly has been moved back to a testing location.

FIG. 21 depicts that the lower assembly 151 has been secured to the drawworks of the rig, e.g. using an elevator 31 of the top drive 30 or otherwise and lifted from its stub 251. Due to the opened recess in the tower 240 the cart could then be shifted back to the testing location, so that the assembly 151 is moved in lateral direction out of the tower recess. The THRT component can now be brought into proper engagement with the TH production tubing hanger and some testing, if desired can be done whilst both the TH and THRT are in proximity of the rig floor 4.

Figure 22:
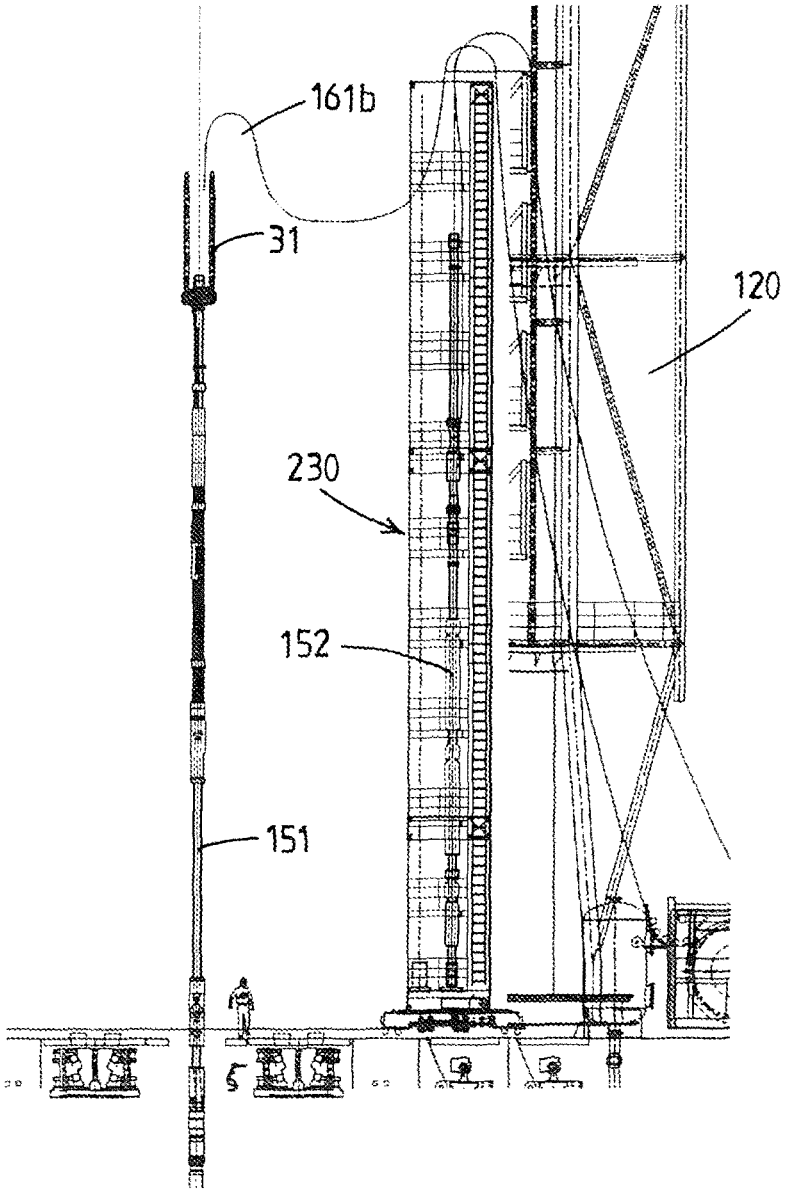
FIG. 22 illustrates the lowering of the interconnected production tubing and assembly.

FIG. 22 depicts the lowering of the assembly 151, here connected to the production tubing 275 via the interconnected TH and THRT, into the marine riser 9. The cart 230 is still in a remote testing location. Once the assembly 151 has been lowered sufficiently, a top portion thereof is held in suitable manner, e.g. using device 270, in proximity of the level of the rig floor, such that the cart 230 can be brought back into deployment location for the removal of the upper assembly 152 from the cart 240 using the drawworks 50. This is done in similar manner as assembly 152. Once suspended from the drawworks 50 the cart 240 is moved away, and the assembly 152 lowered onto the lower assembly 151 and secured to one another.

Figure 23:
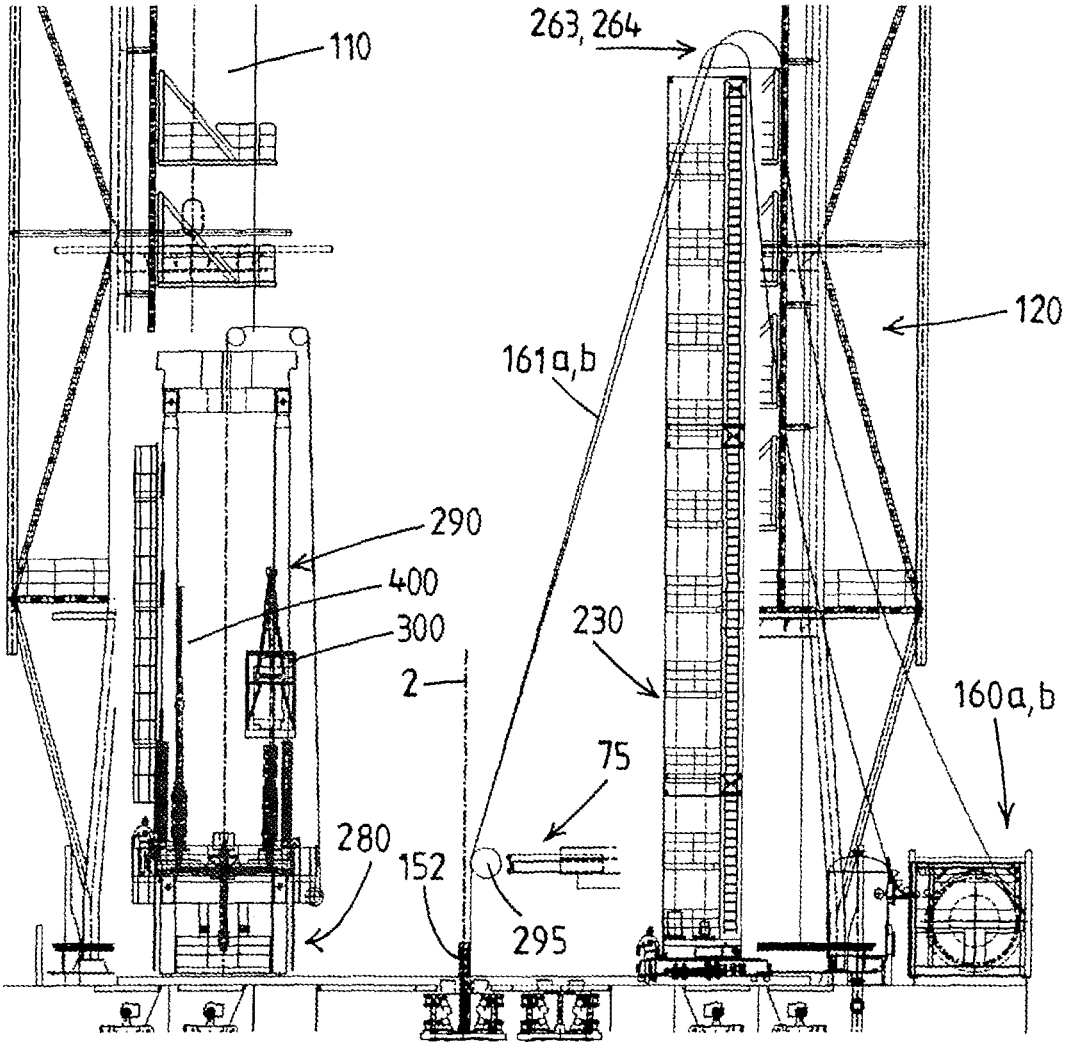
FIG. 23 illustrates the combination of assemblies having been lowered.

FIG. 23 illustrates that the combination of interconnected assemblies 151, 152 has been lowered into the riser 9 with the umbilicals 161*a, b* being guided on the tower top by guides 263, 264 and by one or more auxiliary guides 295 held by a motion arm 75.

FIG. 23 also illustrates the riser tension frame 290 which is disclosed in detail in co-pending NL 2018018 which is incorporated herein by reference.

The riser tension frame 290 is adapted to be suspended from the drawworks 50, allowing to operate the frame in heave compensation mode by means of heave motion functionality of the drawworks as preferred.

The frame 290 is provided with a riser attachment device adapted to attach the riser to the frame. This is depicted in FIG. 24.

Here the frame 290 is suspended from the trolley 20.

The frame 290 comprises a coiled tubing injector 300 as well as a wireline lubricator 400. As preferred each of the injector 300 and lubricator 400 is received by and individually movable within the suspended riser tension frame 290 between a parking position remote from the firing line 2 and an operative position aligned with said firing line 2 allowing to use a selected one of said coiled tubing injector and said wireline lubricator for performing a coiled tubing operation or a wireline operation respectively when aligned with the firing line. As preferred the riser tension frame 290 provides a lateral firing line access passage having a height of at least 40 ft. and a width of at least 1 ft. allowing to transfer an elongated wellbore tool or a wellbore tubular in vertical orientation thereof by means of the motion arm assembly 70, 71, 72, 80, 81, 82 in a substantially lateral motion between and a remote position outside of the riser tension frame and an operative position within the riser tension frame and aligned with the firing line 2.

Figure 24:
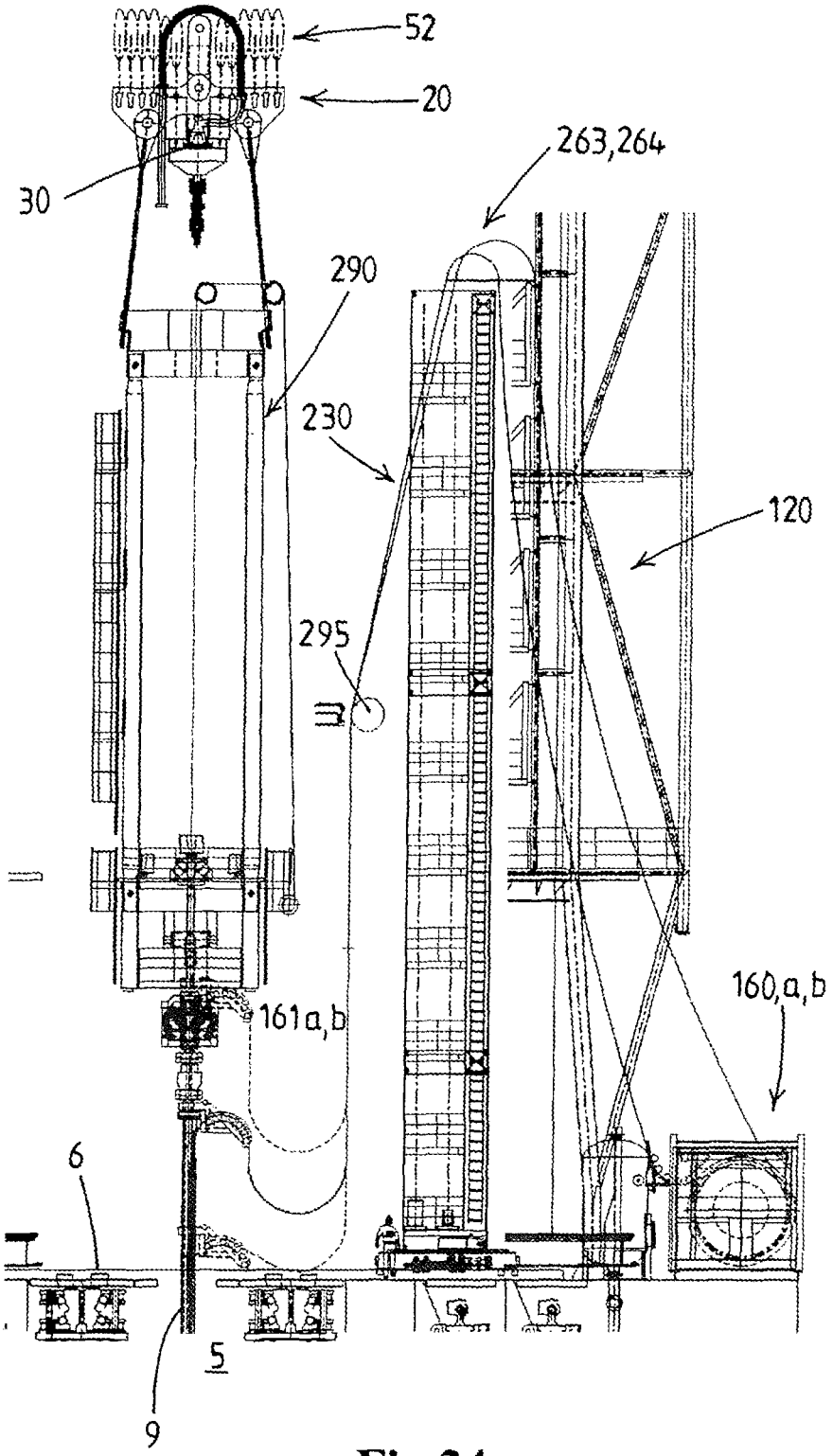
FIG. 24 illustrates the use of a riser tension frame in heave compensation mode in combination with the inventive cart.

FIG. 24 depicts the riser 9 being suspended from riser tension frame 290 that is in turn suspended from the drawworks supported trolley 20. In use the frame 290 moves up and down in heave compensation mode as depicted here by motion of the umbilicals 161*a, b*. The tower 240 is arranged adjacent the tension frame 290 and serves to guide the umbilicals.

The invention claimed is:

1. A method for handling an in-riser landing string assembly onboard a floating vessel, the in-riser landing string assembly being configured to be deployed from said vessel inside a marine riser that extends between said vessel and subsea well equipment by means of landing string tubing in order to conduct one or more operations, wherein the method comprises:

onboard said vessel, transferring the in-riser landing string assembly between a remote location and a deployment location;

using an in-riser landing string assembly cart having a cart base and having a support tower erected on said cart base;

arranging and retaining the in-riser landing string assembly in a vertical orientation on said cart with the support tower providing lateral support for the in-riser landing string assembly; and moving the cart with said in-riser landing string assembly arranged and retained in the vertical orientation thereon between said remote location and said deployment location above the marine riser, wherein the method involves the use of at least one landing string assembly umbilical winch that is arranged adjacent the deployment location, and wherein the method comprises connecting an umbilical of said winch to the in-riser landing string assembly retained by the support tower whilst the cart is offset from the deployment location, and wherein the method comprises a later displacement of the cart to the deployment location with the umbilical remaining connected to the in-riser landing string assembly.

2. The method according to claim 1, wherein the method comprises the deployment of the in-riser landing string assembly into the marine riser, wherein multiple landing string tubing joints are added to the landing string and so the in-riser landing string assembly is lowered down in the marine riser until the subsea equipment is reached where the assembly, or a part thereof, is accommodated.

3. The method according to claim 2, wherein the deployment of the landing string into the marine riser is done with the cart and support tower having been relocated or moved into an offset location remote from the deployment location, with an umbilical passing from an umbilical winch over an umbilical guide that is mounted on the support tower on the cart.

4. The method according to claim 1, wherein a structural frame of the support tower or one or more tower parts thereof is embodied with a recessed receiving space for the in-riser landing string assembly that is open in a lateral side of said structural frame, and wherein the method comprises the introduction or removal of one or more components of the landing string assembly in a lateral direction from the outside into said recessed receiving space and vice versa.

5. The method according to claim 1, wherein an in-riser landing string assembly is transferred by means of the in-riser landing string assembly cart into the deployment location above the marine riser and then one or more landing string tubing joints or stands are connected to a top end of the in-riser landing string assembly and the in-riser landing string assembly is then suspended from said one or more landing string tubing joints or stands, where after the cart with support tower is moved away and placed at a remote location.

6. The method according to claim 5, wherein, with the cart and support tower moved to a location remote from the deployment location, the in-riser landing string assembly is lowered until the landing string tubing passes through a slip device and said slip device is then made to engage on said landing string tubing, followed by stepwise lengthening of the landing string by adding landing string tubing joints or stands, until the assembly is landed onto a tubing hanger of the subsea equipment.

7. A method for handling an in-riser landing string assembly onboard a floating vessel, the in-riser landing string assembly being configured to be deployed from said vessel inside a marine riser that extends between said vessel and subsea well equipment by means of landing string tubing in order to conduct one or more operations, wherein the method comprises:

onboard said vessel, transferring the in-riser landing string assembly between a remote location and a deployment location;

using an in-riser landing string assembly cart having a cart base and having a support tower erected on said cart base;

arranging and retaining the in-riser landing string assembly in a vertical orientation on said cart with the support tower providing lateral support for the in-riser landing string assembly;

moving the cart with said in-riser landing string assembly arranged and retained in the vertical orientation thereon between said remote location and said deployment location above the marine riser;

storing the support tower and one or more in-riser landing string assemblies retained by said support tower as a unit in a horizontal orientation; and upending said unit.

8. A floating vessel provided with an in-riser landing string assembly that is configured to be deployed from said vessel inside a marine riser that extends between said vessel and subsea well equipment by means of landing string tubing in order to conduct one or more operations, wherein the in-riser landing string assembly is transferrable between a remote location and a deployment location, wherein the vessel is provided with an in-riser landing string assembly cart having a cart base and having a support tower erected on said cart base, wherein the cart with the support tower is configured to have the in-riser landing string assembly arranged and retained in a vertical orientation on said cart with the support tower providing lateral support for the in-riser landing string assembly, wherein the cart is configured so that, with said in-riser landing string assembly arranged and retained in the vertical orientation thereon, the cart is movable between said remote location and said deployment location above the marine riser, and wherein the vessel has a wellbore activities installation which comprises:

a mast;

a rig floor having a well center at the deployment location through which a tubulars string can pass along a firing line;

a tubulars storage rack adjacent the mast for storage therein of multi-joint tubular stands;

at least one vertical trolley rail extending along the mast;

a trolley, said trolley being guided along said at least one vertical trolled rail;

a top drive device attached or to be attached to the trolley, said top drive device comprising one or more top drive motors adapted to impart rotary motion to a tubulars string when connected to said top drive device;

a hoisting device or drawworks adapted to move the trolley with the top drive device up and down along said at least one vertical trolley rail;

a vertical motion arm rail extending along the mast;

a motion arm assembly comprising a motion arm base and an extensible and retractable motion arm, wherein the motion arm base is guided by said vertical motion arm rail, and wherein the motion arm has an operative reach that encompasses the firing line, said motion arm assembly being adapted to support at least one of a well center tool and a tubular gripper member, and allowing to bring said well center tool or tubular gripper member in the firing line; and a vertical motion arm drive adapted to move the motion arm base along said vertical motion arm rail.

9. The floating vessel according to claim 8, wherein the vessel is provided with a rail system comprising skid rails extending at least between said remote location and said deployment location, and wherein the cart base is configured to be skidded over said skid rails, and wherein the vessel has a pair of skid rails extending over a rig floor, along opposite sides of a well center, with the cart base being so skiddable into the deployment location above or adjacent the well center.

10. The floating vessel according to claim 8, wherein the vessel comprises at least one landing string assembly umbilical winch that is arranged or is configured to be arranged adjacent the deployment location, and wherein said winch has an umbilical that is connected or is connectable to the in-riser landing string assembly.

11. The floating vessel according to claim 8, wherein the support tower has a tower height of between 20 and 36 meters.

12. The floating vessel according to claim 8, wherein a structural frame of the support tower or one or more tower parts thereof is embodied with a recessed receiving space for the in-riser landing string assembly that is open in a lateral side of said structural frame, said open lateral side allowing for the introduction or removal of one or more components of the landing string assembly in a lateral direction from the outside into said recessed receiving space and vice versa.

* * * * *